US010837688B2

(12) United States Patent
Hoti

(10) Patent No.: US 10,837,688 B2
(45) Date of Patent: Nov. 17, 2020

(54) ICE MAKER WITH EXPOSED REFRIGERANT TUBE

(71) Applicant: Oxen, Inc., Fayetteville, GA (US)

(72) Inventor: Milaim Hoti, Peachtree City, GA (US)

(73) Assignee: Oxen, Inc., Peachtree City, GA (US)

( * ) Notice: Subject to any disclaimer, the term of this patent is extended or adjusted under 35 U.S.C. 154(b) by 66 days.

(21) Appl. No.: 15/635,546

(22) Filed: Jun. 28, 2017

(65) Prior Publication Data

US 2018/0038623 A1 Feb. 8, 2018

Related U.S. Application Data

(63) Continuation of application No. 13/728,555, filed on Dec. 27, 2012, now Pat. No. 9,733,003.

(51) Int. Cl.

| | |
|---|---|
| ***F25C 1/12*** | (2006.01) |
| ***F25C 5/04*** | (2006.01) |
| ***F25C 5/10*** | (2006.01) |

(52) U.S. Cl.
CPC ..... *F25C 1/12* (2013.01); *F25C 5/04* (2013.01); *F25C 5/10* (2013.01)

(58) Field of Classification Search
CPC ..... F25C 1/12; F25C 5/04; F25C 5/10
See application file for complete search history.

(56) References Cited

U.S. PATENT DOCUMENTS

| | | | | |
|---|---|---|---|---|
| 2,217,681 A | | 10/1940 | Jennings et al. | |
| 2,342,743 A | | 2/1944 | Herschel et al. | |
| 2,957,604 A | | 10/1960 | Goldman et al. | |
| 2,997,861 A | * | 8/1961 | Kocher | F25C 1/12 62/344 |
| 3,010,292 A | * | 11/1961 | Newberry | F25C 1/04 62/353 |
| 3,144,755 A | * | 8/1964 | Kattis | F25C 1/12 165/115 |
| 3,393,531 A | * | 7/1968 | Douglas | F25C 1/04 221/150 HC |

(Continued)

FOREIGN PATENT DOCUMENTS

| | | |
|---|---|---|
| GB | 2151008 | 9/1987 |
| JP | S5952167 | 3/1984 |

(Continued)

OTHER PUBLICATIONS

Office Action received from Japanese Patent Office for Japanese Patent Application No. 2015-550739, which claims priority to PCT/US13/77526, dated Dec. 19, 2017.

(Continued)

*Primary Examiner* — Ljiljana V. Ciric
(74) *Attorney, Agent, or Firm* — Thomas Horstemeyer, LLP

(57) ABSTRACT

Systems and apparatuses for making ice and ejecting the ice from an ice formation cell. In one example, a system includes an ice formation cell, a refrigerant tube, and an ejector. The refrigerant tube is disposed within the ice formation cell. A portion of the water stream can freeze on the refrigerant tube to generate the ice piece. The ejector rotates about an axis. When rotating, the ejector pries an ice piece away from the refrigerant tube disposed the ice formation cell.

10 Claims, 21 Drawing Sheets

(56) References Cited

U.S. PATENT DOCUMENTS 3,418,823 A * 12/1968 Vivai ..... F25C 1/08 62/138
3,430,452 A * 3/1969 Dedricks ..... F25C 1/12 62/137
3,775,992 A * 12/1973 Bright ..... F25C 1/24 62/73
3,964,270 A * 6/1976 Dwyer ..... F25C 1/045 62/138
4,199,956 A * 4/1980 Lunde ..... F25C 1/08 366/241
4,341,087 A * 7/1982 Van Steenburgh, Jr. ..... F25C 1/12 62/233
4,344,298 A * 8/1982 Biemiller ..... F25C 1/12 165/115
4,412,429 A * 11/1983 Kohl ..... F25C 5/06 62/347
4,474,023 A * 10/1984 Mullins, Jr. ..... F25C 1/12 62/137
4,489,567 A * 12/1984 Kohl ..... F25C 1/12 62/138
4,555,913 A * 12/1985 Ishiguro ..... F25C 1/12 62/347
4,903,506 A * 2/1990 Delisle ..... F25C 1/12 165/170
4,995,245 A * 2/1991 Chang ..... F25B 39/02 165/135
5,182,925 A * 2/1993 Alvarez ..... F25B 39/024 62/347
5,193,357 A * 3/1993 Kohl ..... B21C 23/10 62/347
6,647,739 B1 * 11/2003 Kim ..... F25C 1/20 62/352
7,673,474 B2 * 3/2010 Athanasiou ..... F25D 23/126 62/430
7,703,299 B2 * 4/2010 Schlosser ..... F25B 39/02 165/171
9,080,799 B2 * 7/2015 Hong ..... F25C 5/182
9,568,228 B2 * 2/2017 Joung ..... F25C 1/00
9,733,003 B2 * 8/2017 Hoti ..... F25C 1/12
10,107,538 B2 * 10/2018 Hoti ..... F25B 39/022
10,254,032 B2 * 4/2019 Knatt ..... F25C 1/25
2004/0083753 A1 * 5/2004 Kim ..... F25C 1/08 62/352
2004/0093878 A1 * 5/2004 Sanuki ..... F25C 1/12 62/135
2005/0150250 A1 * 7/2005 Allison ..... F25C 1/12 62/515
2006/0016207 A1 * 1/2006 Tremblay ..... F25C 1/04 62/342
2007/0101753 A1 * 5/2007 Broadbent ..... F25B 39/02 62/349
2007/0130982 A1 * 6/2007 Wang ..... F25C 1/08 62/344
2010/0011786 A1 * 1/2010 Shin ..... F25C 1/08 62/73
2010/0018239 A1 * 1/2010 Shin ..... F25D 23/126 62/344
2010/0031675 A1 * 2/2010 Kim ..... F25C 1/08 62/73
2011/0005263 A1 * 1/2011 Yamaguchi ..... F25C 1/12 62/347
2011/0192175 A1 * 8/2011 Kuratani ..... F25C 1/08 62/72
2013/0074521 A1 * 3/2013 Joung ..... F25C 1/00 62/3.63
2013/0167575 A1 * 7/2013 Hong ..... F25C 5/22 62/344
2014/0182314 A1 * 7/2014 Hoti ..... F25C 1/12 62/71

FOREIGN PATENT DOCUMENTS

| | | |
|---|---|---|
| JP | 5976966 | 5/1984 |
| JP | 61165564 | 7/1986 |
| JP | 04165277 | 6/1992 |
| JP | H0552673 | 7/1993 |
| JP | 2008275223 | 11/2008 |
| JP | 2008292021 | 12/2008 |

OTHER PUBLICATIONS

Indian Patent Application 5632/DELNP/2015 filed on Dec. 23, 2013, Office Action dated Aug. 5, 2019.
European Patent Application 13868459.2 filed on Dec. 23, 2013, Office Action dated May 13, 2019.
Canadian Patent Application 2,896,317 filed on Dec. 23, 2013, Office Action dated Apr. 11, 2019.
Office Action received for corresponding Brazilian Application No. 11 2015 015669 0 dated Mar. 23, 2020.

* cited by examiner

ICE MAKER WITH EXPOSED REFRIGERANT TUBE

CROSS-REFERENCE TO RELATED APPLICATIONS

This application is a continuation of, claims the benefit of, and priority to U.S. patent application Ser. No. 13/728,555, entitled "ICE MAKER," filed on Dec. 27, 2012, the contents of which are hereby incorporated by reference in their entirety herein.

BACKGROUND

An icemaker may generate ice cubes by freezing liquid water. The ice cubes may be used to chill or prevent spoilage of perishable items, such as food, beverages, and medicine.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1A:
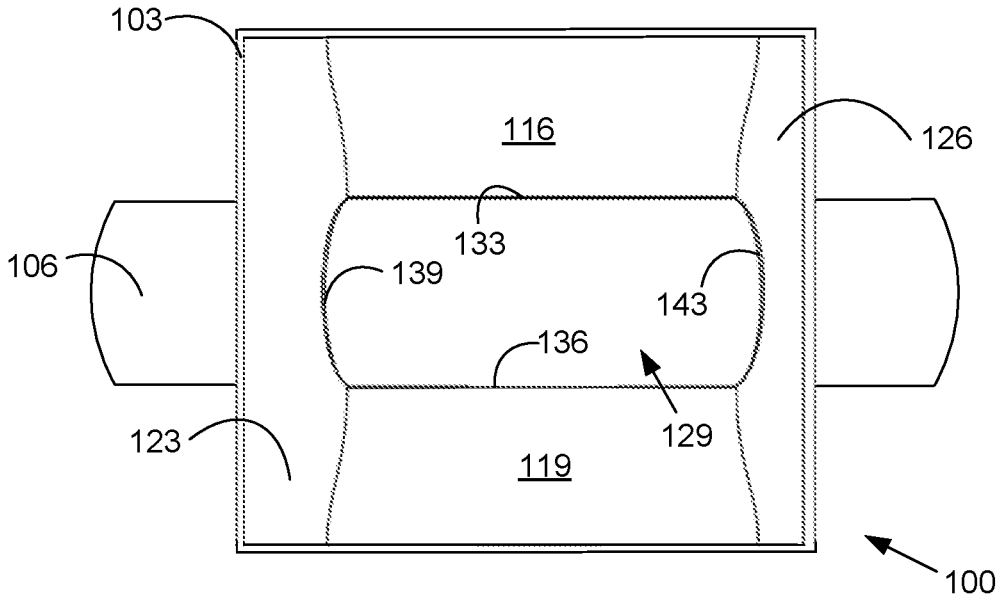
FIGS. 1A-1B show an example of an ice formation unit according to various embodiments of the present disclosure.
Figure 1B:
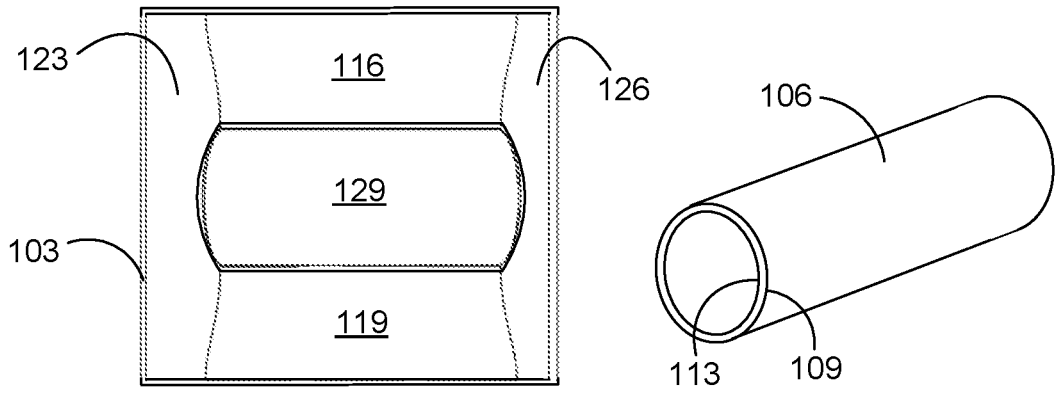

With reference to FIGS. 1A-1B, shown is an example of an ice formation unit 100 according to various embodiments of the present disclosure. The ice formation unit 100 may be used to generate an ice piece (not shown). An ice piece may be a mass of ice that has been generated by freezing liquid water in accordance with the present disclosure. The ice piece that is generated may be used, for example, to chill or prevent spoilage of perishable items, such as food, beverages, medicine, or other types of items.

The ice formation unit 100 may include an ice formation cell 103, a refrigerant tube 106 that is disposed within the ice formation cell 103, and potentially other components. It is noted that in FIGS. 1A-1B, merely a segment of the refrigerant tube 106 is shown.

The refrigerant tube 106 may be a hollow tube that receives and channels a refrigerant (not shown) that causes the temperature of the refrigerant tube 106 to lower. As such, the refrigerant tube 106 may include an outer wall 109, an inner wall 113, and potentially other features. In some embodiments, a cross-section of the refrigerant tube 106 may be rounded and be, for example, circular or oval-shaped. However, a cross-section of the refrigerant tube 106 may have other shapes in alternative embodiments. As will be discussed later, the refrigerant in the refrigerant tube 106 may cause a temperature of the refrigerant tube 106 to reach a level that facilitates the formation of an ice piece. Thus, the refrigerant tube 106 may be constructed of a material that is efficient at transferring heat, such as stainless steel, copper, aluminum, tin, nickel, another type of material, or any combination thereof. Accordingly, in some embodiments, the refrigerant tube 106 may be embodied as an evaporator tube for a refrigeration or ice making system.

In some embodiments, the ice formation cell 103 may be constructed of plastic or any other type of suitable material. The refrigerant tube 106 may be nested at least partially within the ice formation cell 103, and the ice formation cell 103 may receive liquid water (not shown) that is used to generate the ice piece. As such, the ice formation cell 103 may include a first wall 116, a second wall 119, a third wall 123, a fourth wall 126, and an opening 129 that is located between the first wall 116, the second wall 119, the third wall 123, and the fourth wall 126. The opening 129 may be shaped to conform to the refrigerant tube 106 and facilitate water making direct contact with the refrigerant tube 106. Additionally, the refrigerant tube 106 may prevent water from exiting the ice formation cell 103 through the opening 129.

The first wall 116 may have a first straight edge 133, the second wall 119 may have a second straight edge 136, the third wall 123 may have a first curved edge 139, and the fourth wall 126 may have a second curved edge 143 that define the opening 129. When the ice formation unit 100 is assembled, as shown in FIG. 1A, the first straight edge 133 of the first wall 116 and the second straight edge 136 of the second wall 119 may be substantially parallel with respect to the segment of the refrigerant tube 106, and the first curved edge 139 of the third wall 123 and the second curved edge 143 of the fourth wall 126 may be substantially perpendicular to the segment of the refrigerant tube 106.

Next, a general description of the operation of the various components of the ice formation unit 100 is provided. To begin, it assumed that the ice formation unit 100 is assembled as shown in FIG. 1A. Additionally, it is assumed that a cold refrigerant is being provided in the refrigerant tube 106.

Liquid water may be provided to the ice formation cell 103. To this end, water may be dripped, squirted, misted, or supplied by any other fashion to the ice formation cell 103. In some embodiments, the ice formation cell 103 may begin to fill with water due to the refrigerant tube 106 occupying the space provided by the opening 129 and thereby preventing the liquid water from exiting the ice formation cell 103 through the opening 129. In other embodiments, the water may flow across the ice formation cell 103 and the refrigerant tube 106, with the refrigerant tube 106 preventing the liquid water from exiting through the opening 129 of the ice formation cell 103.

With the refrigerant being provided to the refrigerant tube 106, the temperature of the refrigerant tube 106 may lower to a level that is equal to or lower than the freezing point of the water. Thus, the portion of the liquid water that makes contact with the refrigerant tube 106 freezes, thereby generating a thin layer of the ice piece on the refrigerant tube 106. The portion of the water that covers the frozen layer of the ice piece also begins to freeze, thereby adding to the thickness of the ice piece. While the refrigerant tube 106 provides the cold source, the ice piece continues to grow until it reaches a desired size.

Once the ice piece reaches the desired size, the ice piece may be removed from the ice formation unit 100 in various ways. For instance, the ice piece may be removed by hand. In alternative embodiments, the ice piece may simply fall out of the ice formation unit 100. Even further, a lever or other type of tool may be used to pry out the ice piece from the ice formation cell 103 and the refrigerant tube 106.

Figure 2:
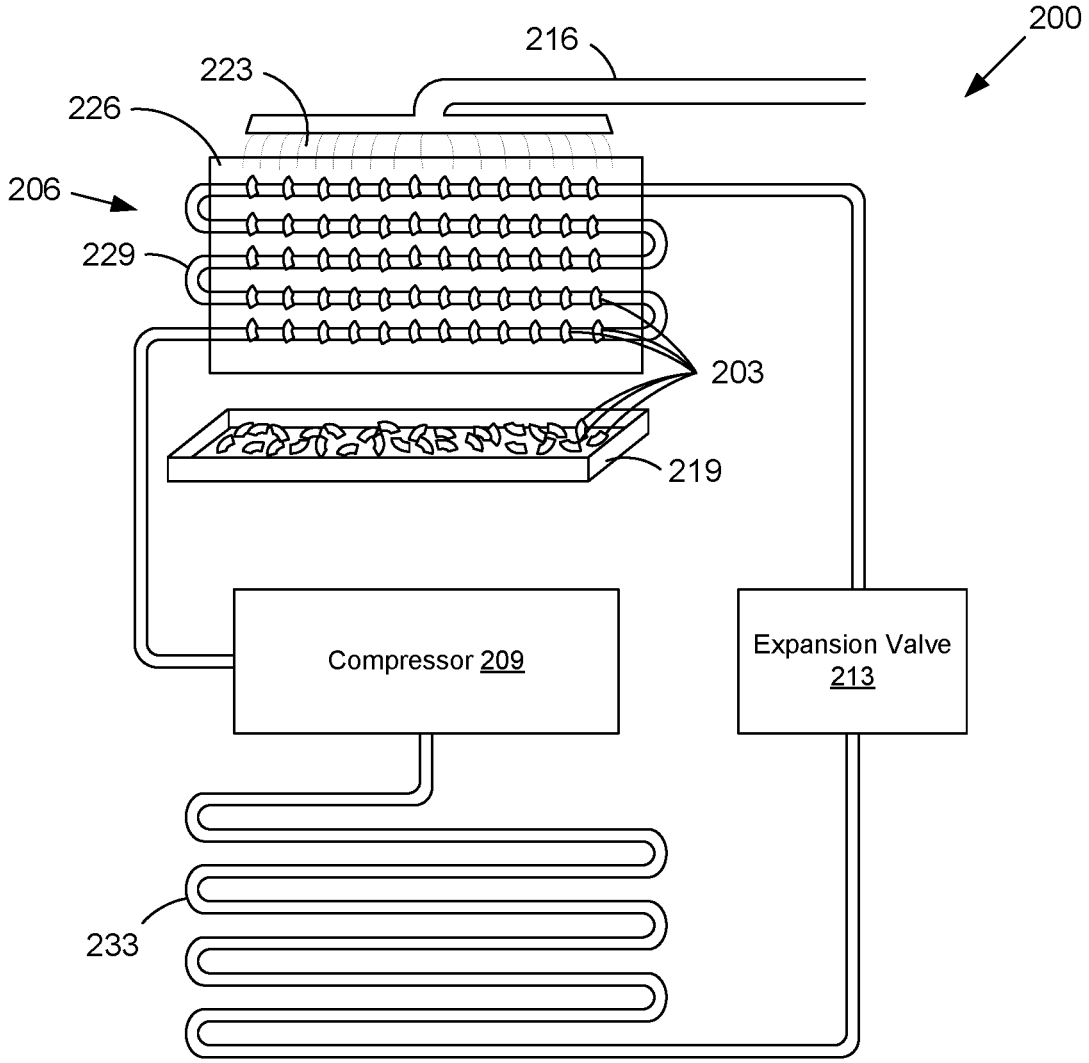
FIG. 2 shows a schematic diagram of an example of an ice making system according to various embodiments of the present disclosure.

Turning now to FIG. 2, shown is a schematic diagram of an example of an ice making system 200 according to various embodiments of the present disclosure. The ice making system 200 may be used in conjunction with the ice formation unit 100 (FIGS. 1A-1B) or with other systems, as will be described. In some embodiments, the ice making system 200 may be a part of a self-contained system that generates and stores the ice pieces, now referred to as the ice pieces 203, that are generated.

The ice making system 200 may include an ice formation assembly 206, a compressor 209, an expansion valve 213, a water supply 216, an ice bin 219, and possibly other components. The water supply 216 may provide a liquid water stream 223 that is used for the formation of the ice pieces 203. To this end, the water supply 216 may be in communication with a faucet, hose, valve, spigot, or any other type of water connection at, for example, a building structure. In some embodiments, the water supply 216 may include filters or other components to remove contaminants from the water provided by the building structure. According to various embodiments, the water stream 223 may be water that is dripped, squirted, sprayed, misted, or supplied in any other fashion to the ice formation assembly 206.

The ice formation assembly 206 may be a portion of the ice making system 200 where the ice pieces 203 are generated. In various embodiments, the ice formation assembly 206 may include one or more ice formation trays 226, one or more evaporator tubes 229, and possibly other components. The ice formation tray 226 is a component of the ice formation assembly 206 that receives the water stream 223. The ice formation tray 226 may also determine or influence the shape of the ice pieces 203 that are generated. According to some embodiments, the ice formation tray 226 may include one or more ice formation cells 103 (FIG. 1).

As will be discussed further below, the evaporator tube 229 may be disposed within at least a portion of the ice formation tray 226. In this sense, the evaporator tube 229 may extend through the ice formation tray 226. The evaporator tube 229 may be a hollow structure that receives and routes a refrigerant. The refrigerant may be any type of fluid that is used in a refrigerating cycle, as may be appreciated by a person having ordinary skill in the art. As will be discussed in more detail later, the ice making system 200 exploits physical properties of the refrigerant to lower the temperature of the evaporator tube 229 to a level that is capable of freezing at least a portion of the water stream 223. Thus, the evaporator tube 229 may be configured to freeze at least a portion of the water stream 223 that comes into direct contact with the evaporator tube 229.

The compressor 209 is in communication with the evaporator tube 229 and a condenser tube 233. The compressor 209 may be a subsystem of the ice making system 200 that is configured to receive the refrigerant from the evaporator tube 229 and compress the refrigerant into the condenser tube 233. As such, the condenser tube 233 may be a hollow structure that receives and routes the refrigerant when at a pressure that is higher than the pressure of the refrigerant when in the evaporator tube 229.

The expansion valve 213 may be a subsystem of the ice making system 200 that controls the refrigerant transitioning from the condenser tube 233 to the evaporator tube 229. As will be discussed later, the transition of the refrigerant at a relatively high pressure in the condenser tube 233 to a relatively lower pressure in the evaporator tube 229 may lower the temperature of the evaporator tube 229 and thereby facilitate generation of the ice pieces 203.

Next, a general description of the operation of the various components of the ice making system 200 is provided. To begin, it is assumed that the ice making system 200 is powered, that the water stream 223 is flowing, and that the evaporator tube 229 is supplied with the refrigerant.

The compressor 209 may begin forcing the refrigerant from the evaporator tube 229 to the condenser tube 233. By forcing the refrigerant into the condenser tube 233, the pressure within the condenser tube 233 may rise. The heat generated by the compression of the refrigerant fluid may be transferred to the condenser tube 233, where some of the heat may be dissipated into the ambient environment.

With the refrigerant at a relatively high pressure in the condenser tube 233, the expansion valve 213 may facilitate at least a portion of the high-pressure refrigerant fluid in the condenser tube 233 transitioning to the evaporator tube 229. Because of the relatively low-pressure state in the evaporator tube 229, the refrigerant may expand upon being exposed to the evaporator tube 229. This expansion of the refrigerant fluid may result in the temperature of the evaporator tube 229 being lowered.

The compressor 209 may then again force the refrigerant from the evaporator tube 229 into the condenser tube 233, and the refrigeration cycle described above may be repeated.

Thus, the temperature of the evaporator tube 229 may be reduced to a level that is capable of freezing water in the water stream 223.

Figure 3:
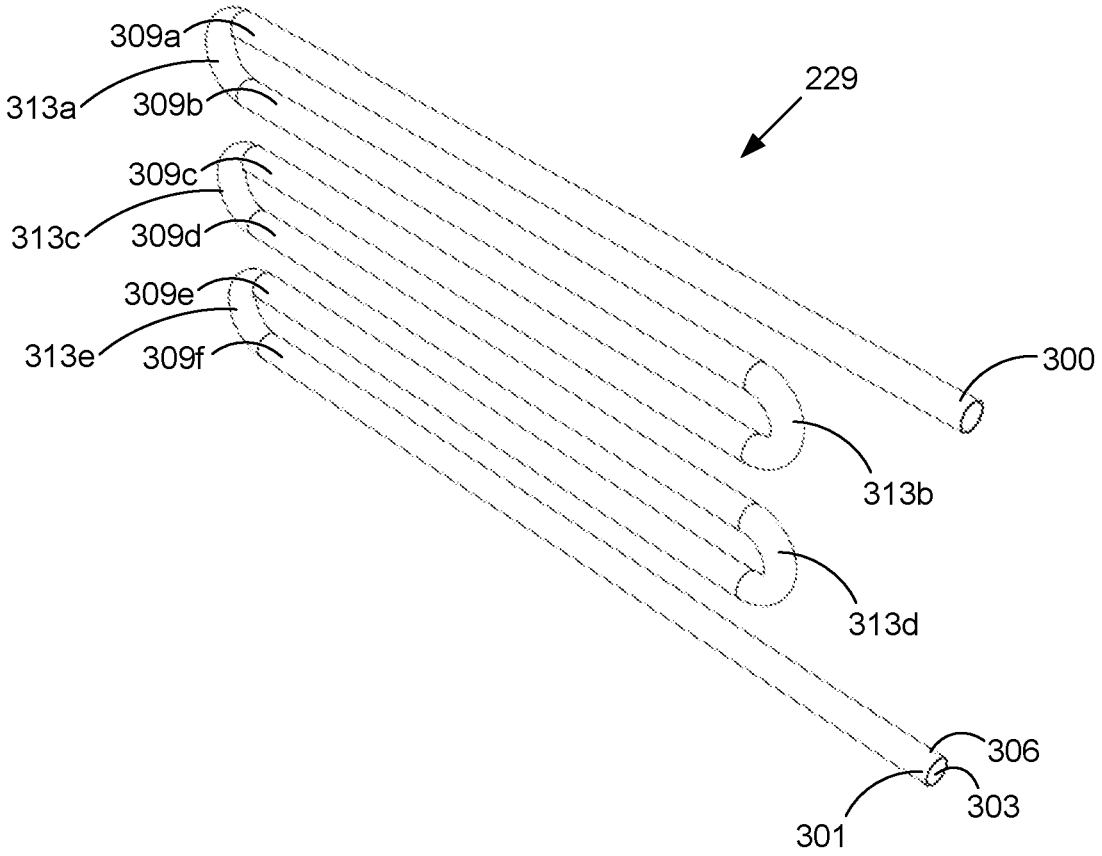
FIG. 3 shows an example of an evaporator tube for the ice making system of FIG. 2 according to various embodiments of the present disclosure.

Turning now to FIG. 3, shown is an example of the evaporator tube 229 for the ice making system 200 (FIG. 2) according to various embodiments of the present disclosure. The evaporator tube 229 may include a first end 300 that connects to the expansion valve 213 (FIG. 2) and a second end 301 that connects to the compressor 209 (FIG. 1) Also, the evaporator tube 229 may include an inner wall 303 and an outer wall 306. In some embodiments, the outer wall 306 may be curved, but other shapes may be used as well. According to some embodiments, the evaporator tube 229 may include one or more straight segments 309*a*-309*f*, one or more curved segments 313*a*-313*e* that connect the straight segments 309*a*-309*f*, and possibly other components not discussed in detail herein. Although the present embodiment shows the straight segments 309*a*-309*f* and the curved segments 313*a*-313*e*, it is understood that fewer or greater quantities of these components may be used in various embodiments.

As previously mentioned, the evaporator tube 229 may receive and channel a refrigerant that lowers the temperature of the evaporator tube 229 and facilitates generating the ice pieces 203 (FIG. 1). As such, the evaporator tube 229 may be constructed of a material that facilitates heat transfer. As non-limiting examples, such a material may be stainless steel, copper, brass, aluminum, nickel, tin, any other material, or any combination thereof. Additionally, the evaporator tube 229 may comprise a grooved interior wall.

Figure 4A:
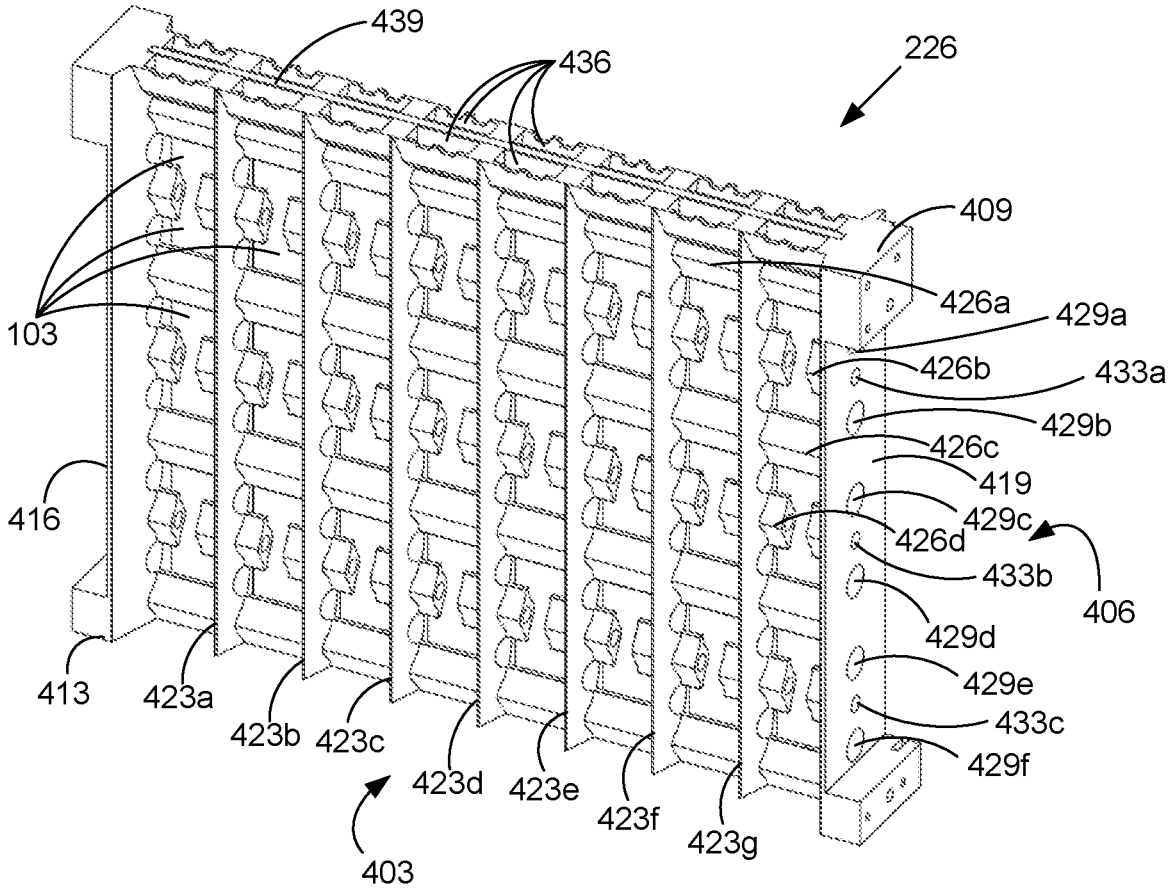
FIGS. 4A-4B show an example of an ice formation tray for the ice making system of FIG. 2 according to various embodiments of the present disclosure.
Figure 4B:
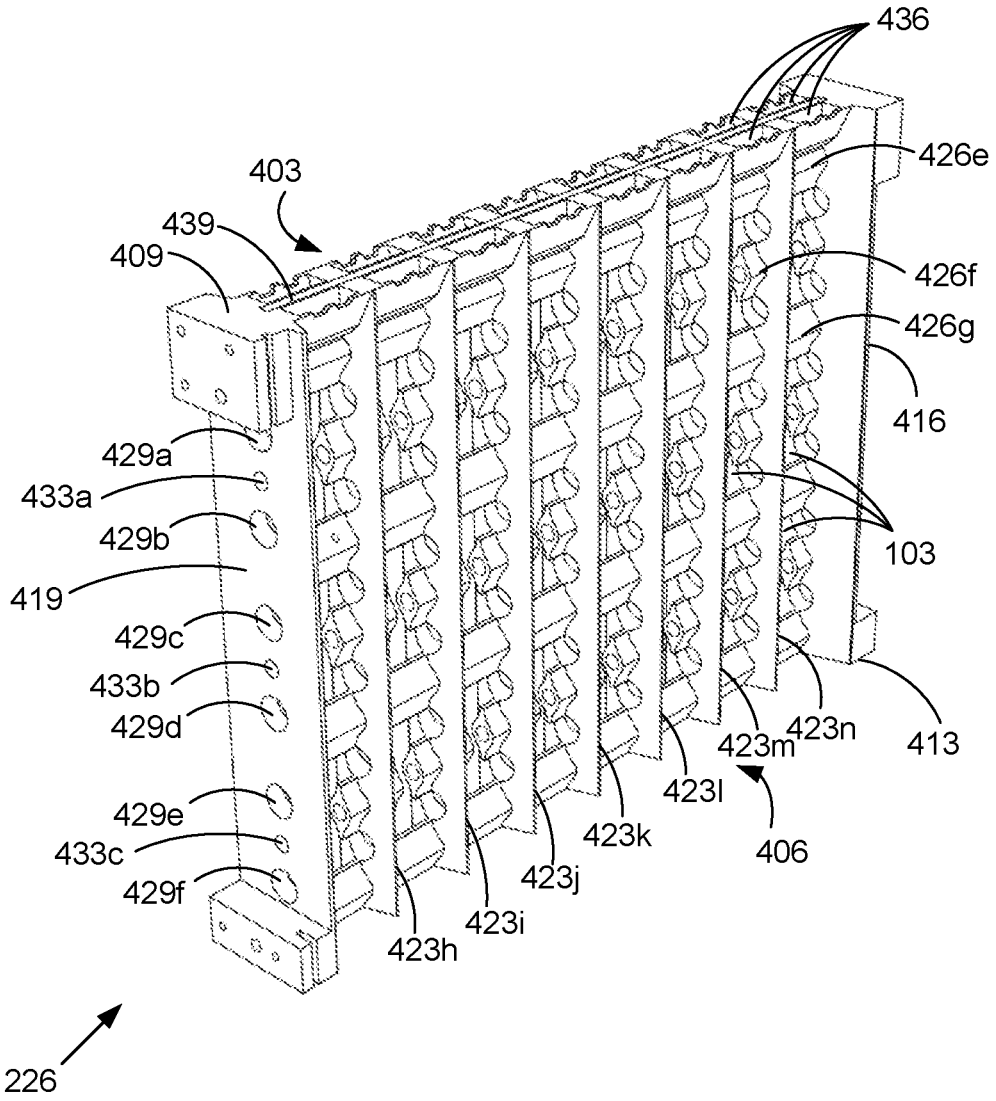

Turning now to FIGS. 4A-4B, shown is an example of the ice formation tray 226 for the ice making system 200 (FIG. 2) according to various embodiments of the present disclosure. The ice formation tray 226 in the present embodiment includes multiple ice formation cells 103 that may be arranged, for example, in columns and rows. It is noted that in FIGS. 4A-4B, only some of the ice formation cells 103 are labeled for clarity. Also, it is understood that other embodiments may include fewer or greater quantities of columns, row, and/or ice formation cells 103 than those shown in FIGS. 4A-4B.

The ice formation tray 226 may include a first side 403, a second side 406, a top 409, a bottom 413, a first side wall 416, and second side wall 419. As shown, multiple ice formation cells 103 may be on the first side 403 and the second side 406 of the ice formation tray 226. The first side 403 and the second side 406 of the ice formation tray 226 may also include one or more dividers 423*a*-423*g* that separate ice formation cells 103 in one direction. In the embodiment shown, the dividers 423*a*-423*g* separate the ice formation cells 103 in the horizontal direction. The ice formation tray 226 may also include bevels 426*a*-426*g* that separate the ice formation cells 103, for example in the vertical direction. It is noted that only some of the bevels 426*a*-426*g* are labeled for clarity.

The ice formation tray 226 in various embodiments may also include one or more first bores 429*a*-429*f* and one or more second bores 433*a*-433*c*. Various embodiments may include fewer or greater numbers of first bores 429*a*-429*f* and second bores 433*a*-433*c* than those shown in FIGS. 4A-4B. The first bores 429*a*-429*f* may extend from the first side wall 416 to the second side wall 419 of the ice formation tray 226 and may be configured to receive the evaporator tube 229 (FIG. 2). Similarly, the second bores 433*a*-433*c* may extend from the first side wall 416 to the second side wall 419 of the ice formation tray 226 and may be configured to receive an ejector shaft (not shown), which will be discussed later.

The ice formation tray 226 may also include one or more inlets 436 and a receptacle 439. For clarity, only some of the inlets 436 are labeled in FIGS. 4A-4B. As will be discussed later, the inlets 436 may receive the water stream 223 (FIG. 2), and guide portions of the water stream 223 that are to be provided to the ice formation cells 103. To this end, the inlets 436 may include an opening, such as a slot, orifice, or other type of mechanism to facilitate guiding the water stream 223 to the ice formation cells 103. The receptacle 439 may receive and retain an extension from a water guide (not shown), which will be discussed later.

Figure 5:
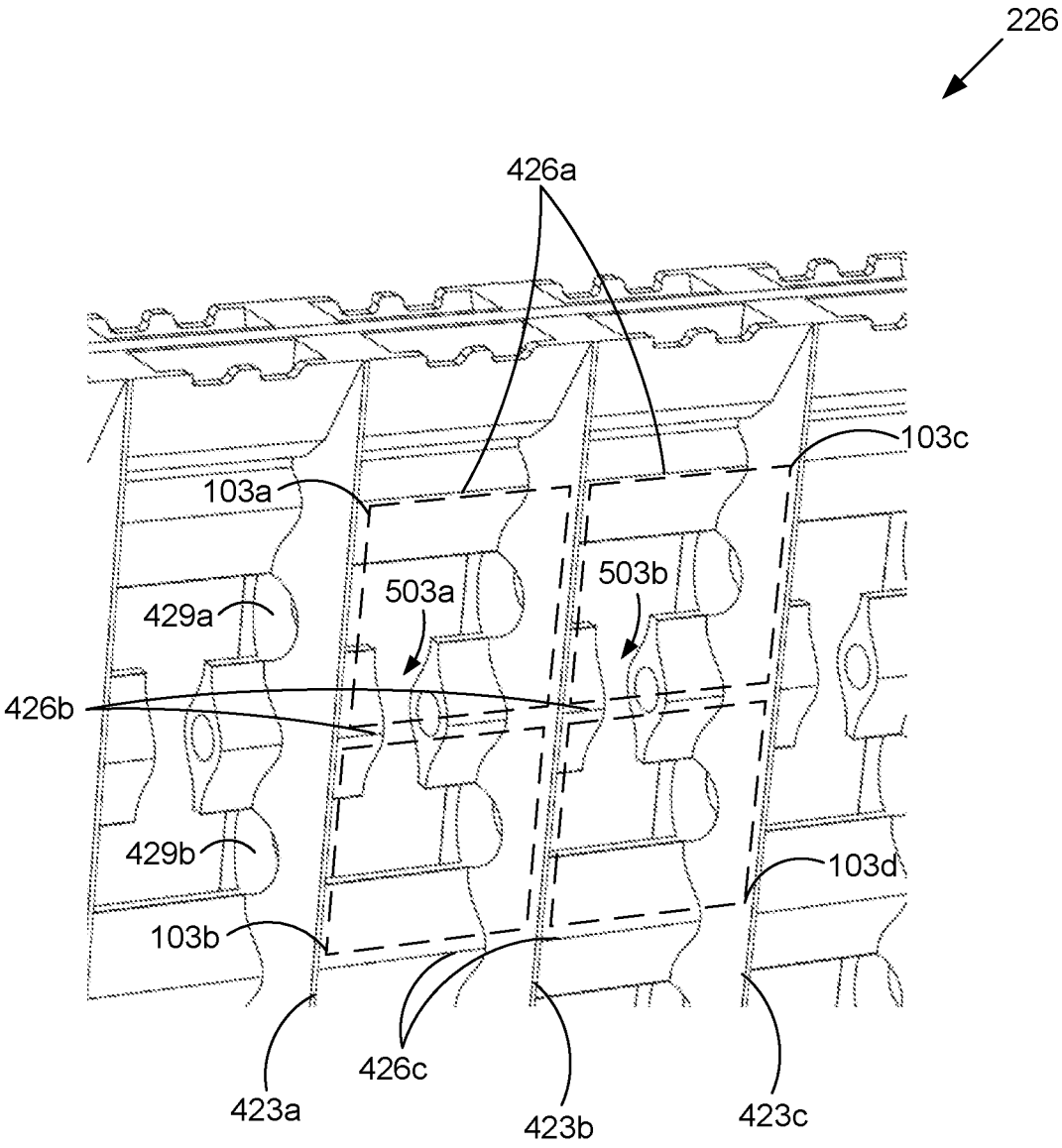
FIG. 5 shows an example of a portion of the ice formation tray of FIGS. 4A-4B according to various embodiments of the present disclosure.

Turning now to FIG. 5, shown is a portion of the ice formation tray 226 for the ice formation system 200 (FIG. 2) according to various embodiments. The portion of the ice formation tray 226 shown includes a first ice formation cell 103*a*, a second ice formation cell 103*b*, a third ice formation cell 103*c*, and a fourth ice formation cell 103*d*, as indicated generally by the dashed boxes. The first ice formation cell 103*a* is bounded by the bevels 426*a*-426*b* and the dividers 423*a*-423*b*. Similarly, the second ice formation cell 103*b* is bounded by the bevels 426*b*-426*c* and the dividers 423*a*-423*b*. The third ice formation cell 103*c* is bounded by the bevels 426*a*-426*b* and the dividers 423*b*-423*c*. Likewise, the fourth ice formation cell 103*d* is bounded by the bevels 426*b*-426*c* and the dividers 423*b*-423*c*.

In some embodiments, at least one of the bevels 426*a*-426*c* for each of the ice formation cells 103*a*-103*d* may include a slot 503*a*-503*b*. The slots 503*a*-503*b* may accommodate an ejector (not shown) to facilitate removing ice pieces 203 (FIG. 2).

Figure 6:
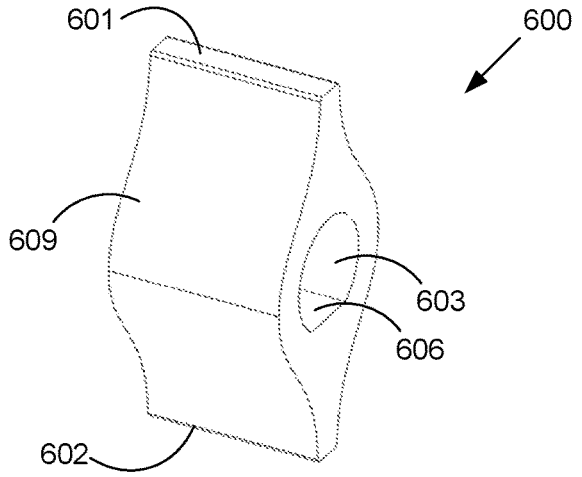
FIG. 6 shows an example of an ejector for the ice making system of FIG. 2 according to various embodiments of the present disclosure.

Turning now to FIG. 6, shown is an example of an ejector 600 for the ice formation system 200 (FIG. 2) according to various embodiments of the present disclosure. The ejector 600 may facilitate removal of an ice piece 203 (FIG. 2). To this end, the ejector 600 may be configured to fit in one of the slots 503*a*-503*b* (FIG. 5) in the bevel 426*b* (FIG. 5) of one of the ice formation cells 103*a*-103*d*. The ejector 600 may have a first end 601 and a second end 602 configured to pry an ice piece 203 away from the ice formation tray 226 (FIGS. 4A-4B) and/or the evaporator tube 229 (FIG. 3). The ejector 600 may also include a bore 603 to facilitate a connection of the ejector 600 with a shaft (not shown). Additionally, the bore 603 may include a flat side 606 that prevents the ejector 600 from rotating about the shaft, as will be discussed in more detail later. Accordingly, a rotation of the shaft may cause the ejector 600 to rotate with the shaft and the first end 601 and/or second end 602 to pry one or more ice pieces 203 away from the ice formation tray 226 and/or the evaporator tube 229. Also, the ejector 600 may have an outer surface 609 that has a shape similar to that of the bevel 426*b*. Thus, the ejector 600 may function similar to the bevel 426*b* when the ejector 600 is not being used to remove an ice piece 203.

Figure 7:
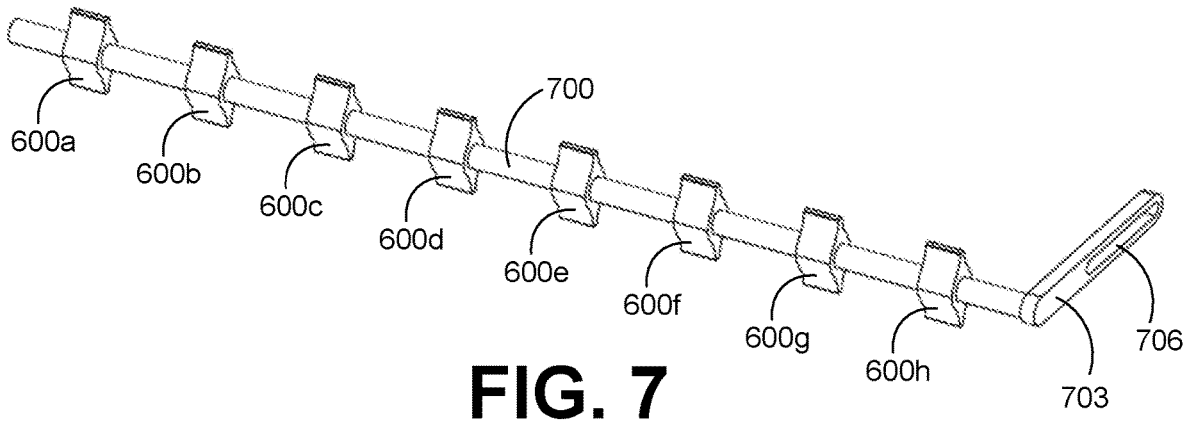
FIG. 7 shows an example of multiple ejectors of FIG. 6 mounted to an ejector shaft according to various embodiments of the present disclosure.

Turning now to FIG. 7, shown is a drawing of multiple ejectors 600, referred to herein as ejectors 600*a*-600*h*, mounted to an ejector shaft 700. The ejector shaft 700 may be configured to insert into one of the second bores 433*a*-433*c* (FIGS. 4A-4B) in the ice formation tray 226 (FIGS. 4A-4B). Additionally, the ejector shaft 700 may rotate while in one of the second bores 433*a*-433*c* about an axis defined by the ejector shaft 700. To this end, an end of the ejector shaft 700 may be fixedly connected to a link 703. The link 703 may include a slot 706 to facilitate the rotation of the ejector shaft 700, as will be described later.

Figure 8A:
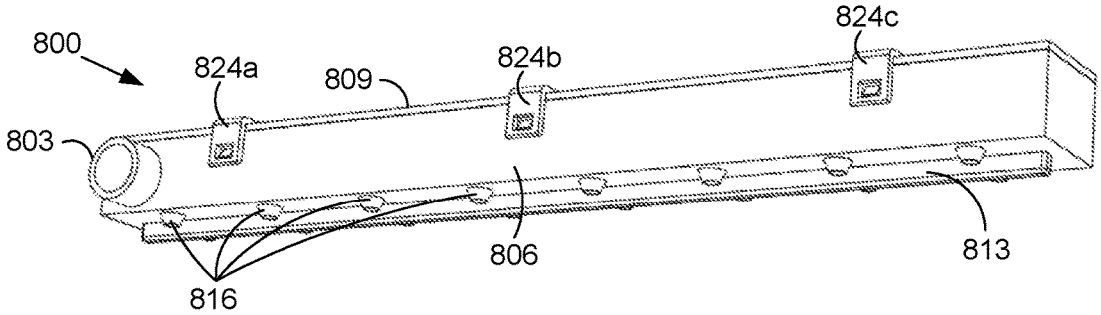
FIGS. 8A-8C show examples of a water guide for the ice making system of FIG. 2 according to various embodiments of the present disclosure.
Figure 8B:
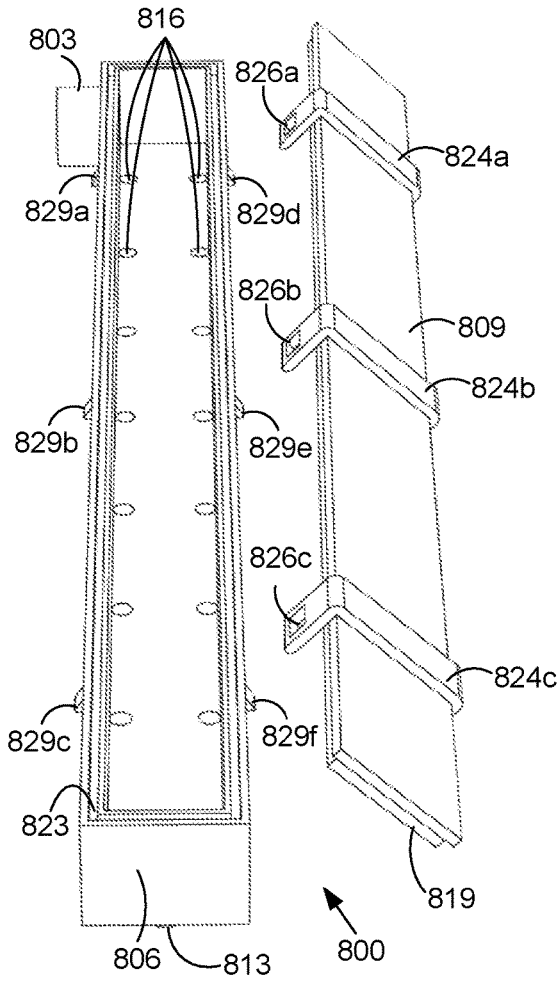
Figure 8C:
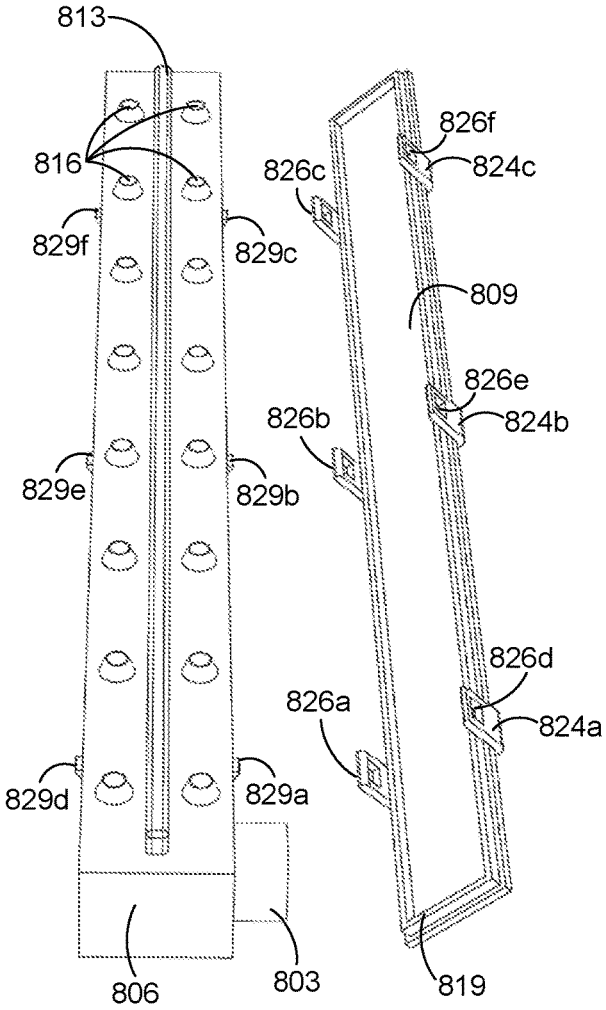

Reference is now made to FIGS. 8A-8C. FIGS. 8A-8C show a water spray guide 800 for the ice making system 200 (FIG. 2) according to various embodiments of the present disclosure. The water spray guide 800 may receive water from the water supply 216 (FIG. 2) and provide the water stream 223 (FIG. 2) to the ice formation tray 226 (FIGS. 4A-4B). To this end, the water spray guide 800 may include a connector 803, a water bin 806, a removable lid 809, and possibly other components not discussed in detail herein. The connector 803 may serve as a connection point between the water bin 806 and the water supply 216. As such, the connector 803 may be hollow to facilitate water flowing into the water bin 806.

The water bin 806 may be mounted to the ice formation tray 226 (FIGS. 4A-4B). To this end, the water bin 806 may include an extension 813 that inserts into the receptacle 439 of the ice formation tray 226. Upon the extension 813 being inserted into the receptacle 439, the water bin 806 may be restricted to the ice formation tray 226 until being removed by, for example, being pulled away from the ice formation tray 226. According to various embodiments, the extension 813 may further include one or more protrusions (not shown) that engage and snap into corresponding sockets (not shown) in the receptacle 439. Such protrusions may resist the water bin 806 being removed from the ice formation tray 226.

The water bin 806 may also provide the water stream 223 to the inlets 436 (FIGS. 4A-4B) of the ice formation tray 226. To this end, the water bin 806 may include one or more orifices 816 through which water may pass. The orifices 816 of the water bin 806 may be located and spaced within the water bin 806 so that substantially equal portions of the water stream 223 are provided to each of the inlets 436 of the ice formation tray 226. For example, the openings of the orifices 816 may get progressively larger as the distance from the connector 803 increases, thereby facilitating substantially equal portions of the water stream 223 being provided to each inlet 436 of the ice formation tray 226.

The removable lid 809 may prevent contaminants from entering the water stream 223 that is provided to the ice formation tray 226. By being removable, the removable lid 809 may facilitate cleaning of, for example, the water bin 806, the removable lid 809, the connector 803, and possibly other components. A lip 819 (visible in FIGS. 8B-8C) may extend from the removable lid 809. The lip 819 may insert or snap into a groove 823 (visible in FIG. 8B) in the water bin 806, thereby facilitating the removable lid 809 being retained to the water bin 806. Furthermore, one or more arms 824*a*-824*c* may be attached to or be formed as part of the removable lid 809 or the water bin 806. The arms 824*a*-824*c* may restrict the removable lid 809 to the water bin 806. To this end, the arms 824*a*-824*c* may include receptacles 826*a*-826*f* that receive corresponding protrusions 829*a*-829*f*. The protrusions 829*a*-829*f* may insert into the corresponding receptacles 826*a*-826*c* and prevent the removable lid 809 from being unintentionally removed from the water bin 806.

Figure 9A:
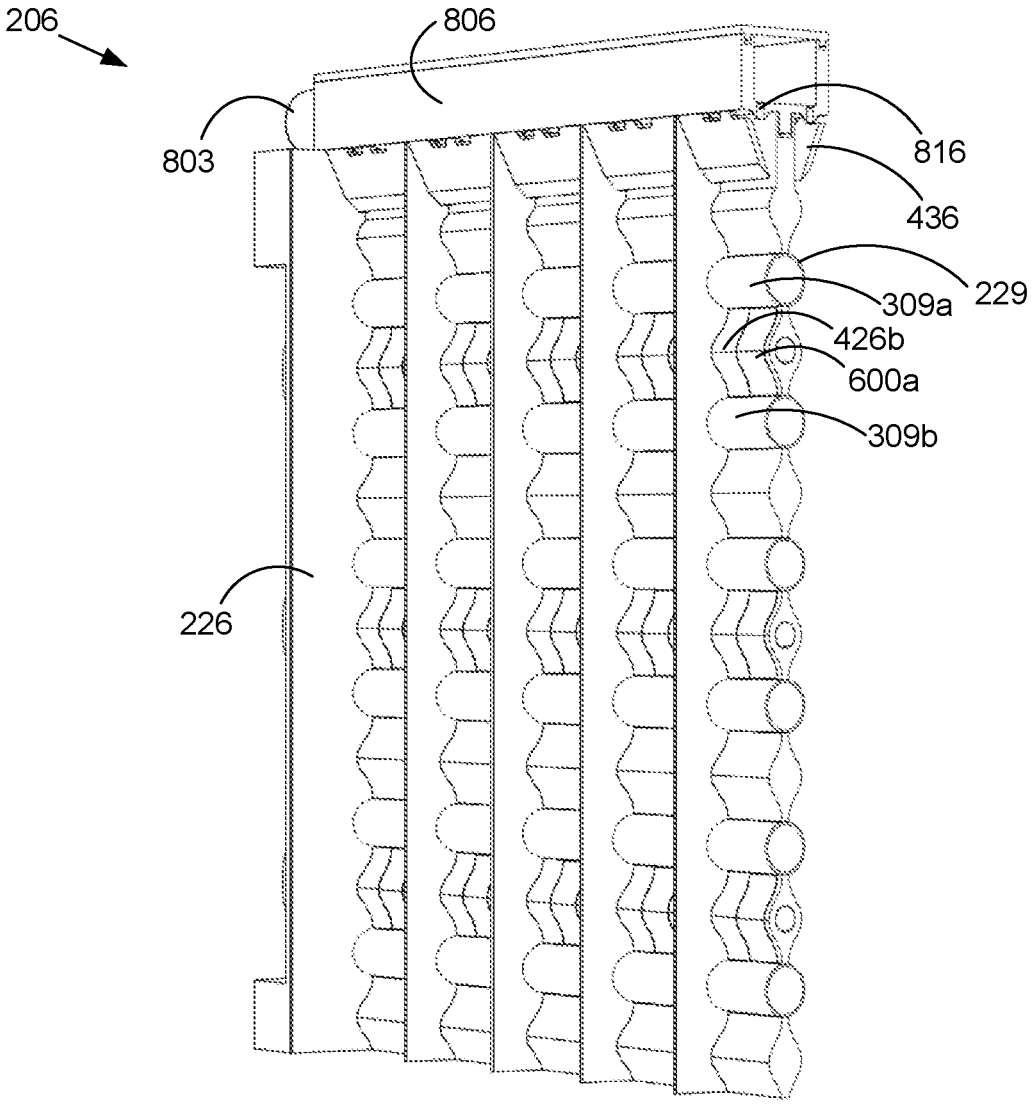
FIGS. 9A-9C show examples of an ice formation assembly for the ice formation system of FIG. 2 according to various embodiments of the present disclosure.
Figure 9B:
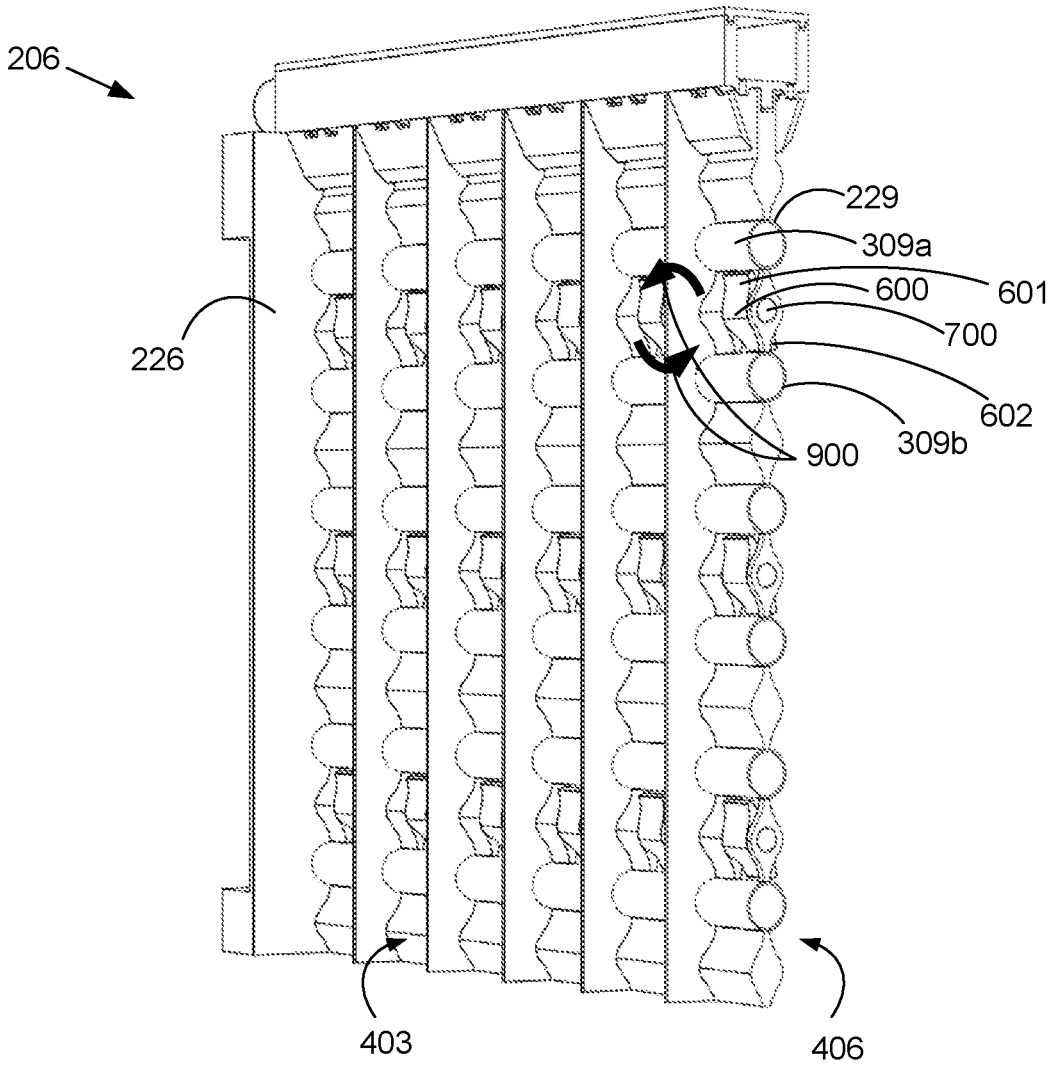
Figure 9C:
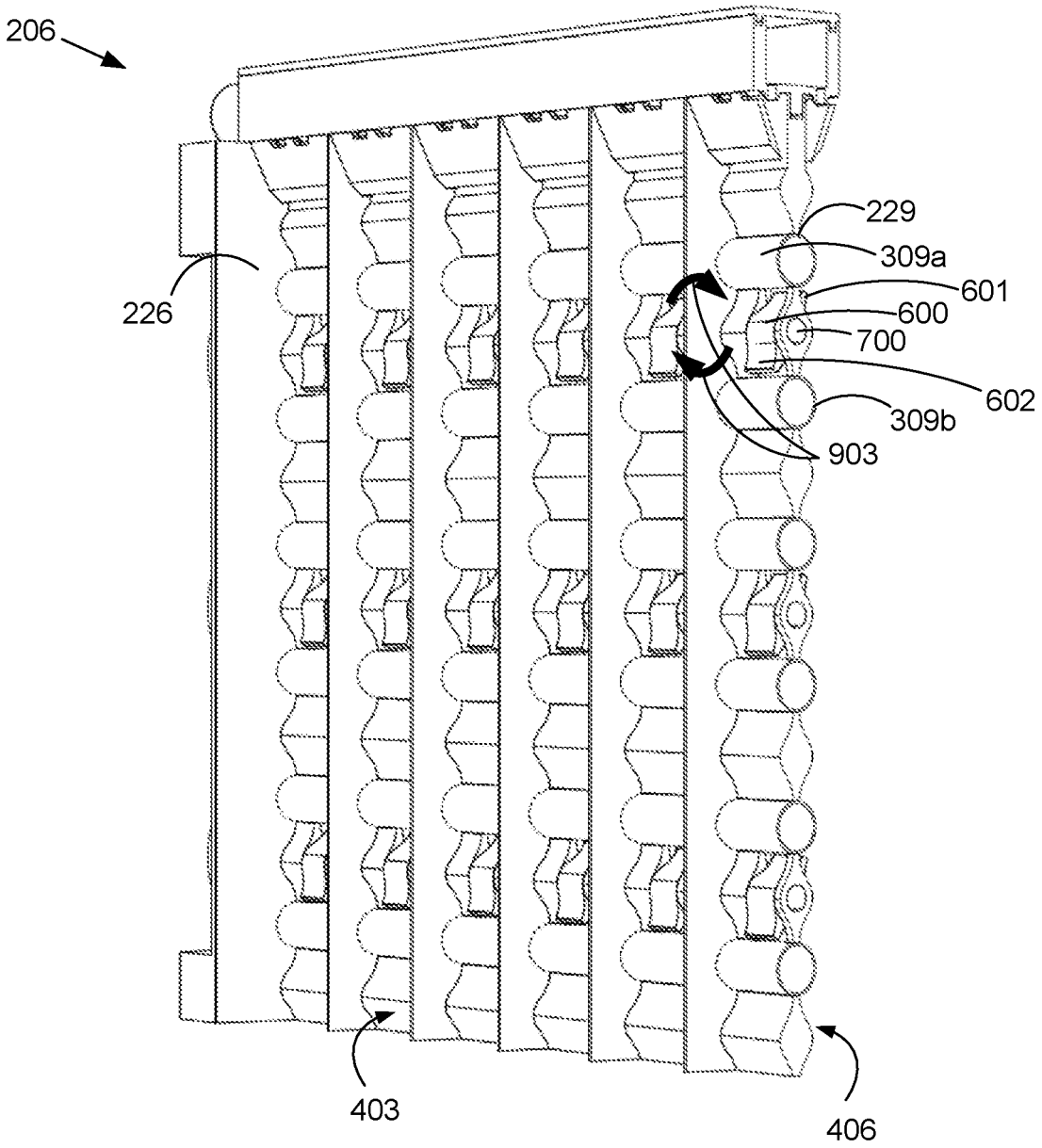

Next, a general description of the operation of portions of the ice formation assembly 206 according to various embodiments is provided with reference to FIGS. 9A-9C. FIGS. 9A-9C show examples of the ice formation assembly 206 for the ice formation system 200 (FIG. 2) according to various embodiments of the present disclosure. Although the following discussion describes the process of creating ice pieces 203 (FIG. 1) with respect to a single column of ice formation cells 103*a*-103*f*, it is understood that a similar process may occur for all columns of the ice formation cells 103.

To begin, it is assumed that a refrigerant is being provided to the evaporator tube 229 and that the evaporator tube 229 has reached a temperature that is below the freezing point of water. In addition, it is assumed that the water supply 216 (FIG. 2) is providing liquid water to the water bin 806 through the connector 803. With the water supply 216 providing the water to the water bin 806, the water may pass through the orifices 816 of the water bin 806 into the inlet 436 of the ice formation tray 226. From the inlet 436 of the ice formation tray 226, the water may flow down to the bevel 426*a* and then to the first straight segment 309*a* of the evaporator tube 229. Upon the water stream 223 making contact with the evaporator tube 229, the portion of the water stream 223 that makes direct contact with the evaporator tube 229 freezes, thereby generating a thin layer of an ice piece 203.

The portion of the water stream 223 that does not freeze may continue to flow down to the over the bevel 426*b* and the ejector 600*a*. A portion of the water stream 223 may then contact the next straight segment 309*b* of the evaporator tube 229. Again, a portion of the water stream 223 that makes direct contact with the evaporator tube 229 freezes, and a portion that that does not freeze may continue to flow down. The process may continue until the water stream 223 reaches the bottom of the ice formation tray 226. Thus, layers of ice pieces 203 begin to grow over the evaporator tube 229. In some embodiments, the portion of the water stream 223 that reaches the bottom of the ice formation tray 226 may be drained. In other embodiments, this portion of the water stream 223 may be recirculated and incorporated it into the water supply 216 or the water stream 223.

As the water supply 216 continues to provide water to the water bin 806, the water stream 223 continues to flow. Portions of the water stream 223 that flow over the thin layers of the ice pieces 203 may freeze, thereby growing the ice pieces 203. The particular shapes of the ice pieces 203 may be determined at least in part by the shapes of the evaporator tube 229, the ejectors 600, and the bevels 426. Once the ice pieces 203 have grown to their desired sizes, the process of removing the ice pieces 203 may begin.

Turning now to FIG. 9B, shown is an example of the ice formation assembly 206 performing a maneuver to remove ice pieces 203 (not shown) from the ice formation tray 226 and the evaporator tube 229. Although the following description makes reference to only one of the ejectors 600, it is understood that a similar process may be performed by the other ejectors 600 as well.

FIG. 9B shows the ice formation assembly 206 after the ejector 600 has been rotated to remove two ice pieces 203. In particular, FIG. 9B shows the rotation of the ejector 600 that may remove two ice pieces 203 from the ice formation tray 226 and the evaporator tube 229. To this end, the ejector shaft 700 may rotate in the direction as indicated by the arrows 900. Because the ejector 600 rotates in conjunction with the ejector shaft 700, the first end 601 of the ejector 600 is displaced with respect to the first straight segment 309*a* of the evaporator tube 229. Simultaneously, the second end 602 of the ejector 600 is displaced with respect to the second straight segment 309*b* of the evaporator tube 229. As shown, the displacement of the first end 601 of the ejector 600 is in an opposite direction of the displacement of the second end 602 of the ejector 600. The displacement of the first end 601 of the ejector 600 may pry a first ice piece 203 (not shown) away from the first straight segment 309*a* of the evaporator tube 229 and the first side 403 of the ice formation tray 226. Similarly, the displacement of the second end 602 of the ejector 600 may pry a second ice piece 203 (not shown)

away from the second straight segment 309*b* of the evaporator tube 229 and the second side 406 of the ice formation tray 226. When the ice pieces 203 are removed from the evaporator tube 229 and the ice formation tray 226, the ice pieces 203 may fall, for example, into the ice bin 219 (FIG. 2). The ejector shaft 700 may then return to the position shown in FIG. 9A, thereby retuning the ejector 600 to the position shown in FIG. 9A.

Additionally, in some embodiments, the cooling cycle of the ice making system 200 may be reversed to send hot gases through the evaporator tube 229 to reduce the strength of the bond between the evaporator tube 229 and the ice pieces 203. Reducing the strength of the bond between the evaporator tube 229 and the ice pieces 203 may facilitate the ejector 600 removing an ice piece 203 from the evaporator tube 229. This procedure is described in more detail later with reference to FIG. 15.

Turning now to FIG. 9C, shown is an example of the ice formation assembly 206 removing additional ice pieces 203 (not shown) from the ice formation tray 226 and the evaporator tube 229. Although the following description makes reference to only one of the ejectors 600, it is understood that a similar process may be performed by the other ejectors 600 as well.

FIG. 9C shows the ice formation assembly 206 after the ejector 600 has been rotated to remove two additional ice pieces 203. In particular, FIG. 9C shows the rotation of the ejector 600 that may remove two ice pieces 203 from the ice formation tray 226 and the evaporator tube 229. To this end, the ejector shaft 700 may rotate in the direction as indicated by the arrows 903. Because the ejector 600 rotates in conjunction with the ejector shaft 700, the first end 601 of the ejector 600 is displaced with respect to the first straight segment 309*a* of the evaporator tube 229. Simultaneously, the second end 602 of the ejector 600 is displaced with respect to the second straight segment 309*b* of the evaporator tube 229. As shown, the displacement of the first end 601 of the ejector 600 is in an opposite direction of the displacement of the second end 602 of the ejector 600. The displacement of the first end 601 of the ejector 600 may pry a third ice piece 203 (not shown) away from the first straight segment 309*a* of the evaporator tube 229 and the second side 406 of the ice formation tray 226. Similarly, the displacement of the second end 602 of the ejector 600 may pry a fourth ice piece 203 (not shown) from the evaporator tube 229 the second straight segment 309*b* of the evaporator tube 229 and the first side 403 of the ice formation tray 226. When the ice pieces 203 are removed from the evaporator tube 229 and the ice formation tray 226, the ice pieces 203 may fall, for example, into the ice bin 219 (FIG. 2). The ejector shaft 700 may then return to the position shown in FIG. 9A, thereby returning the ejector 600 to the position shown in FIG. 9A.

Figure 10A:
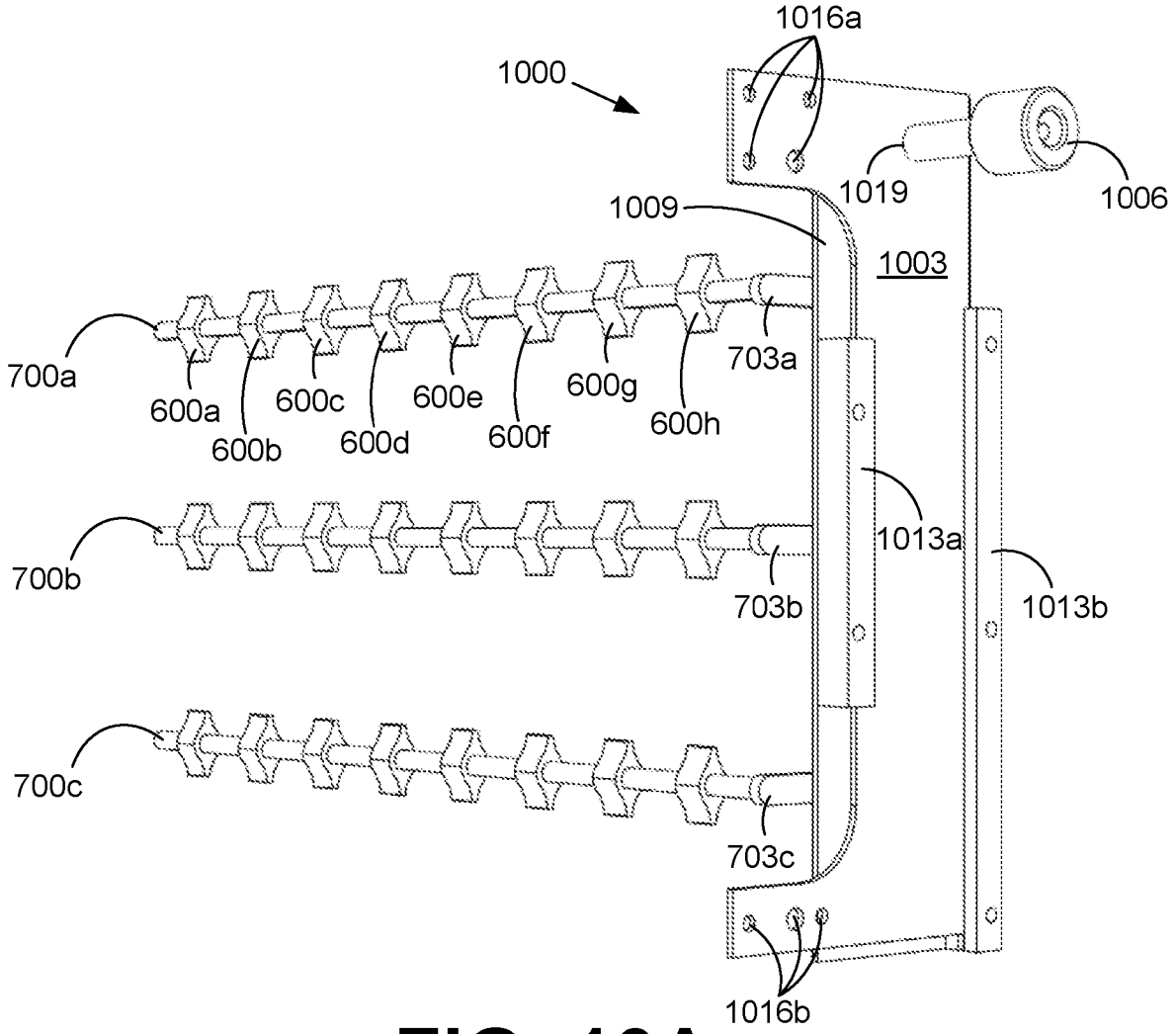
FIGS. 10A-10B show examples of an ejector shaft driver assembly for the ice formation assembly of FIGS. 9A-9C according to various embodiments of the present disclosure.
Figure 10B:
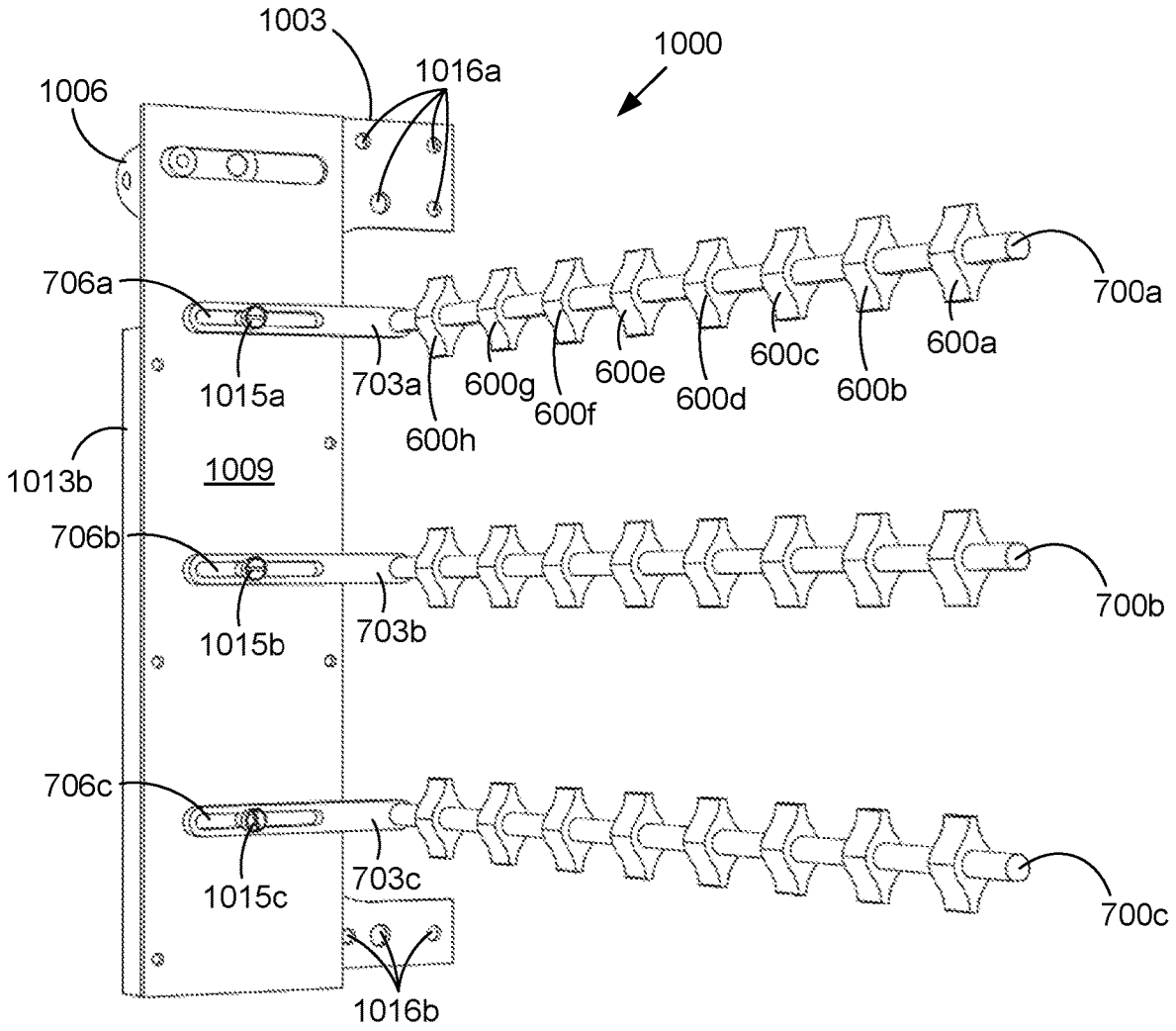

Reference is now made to FIGS. 10A-10B. FIGS. 10A-10B show an example, among others, of an ejector shaft driver assembly 1000 according to various embodiments of the present disclosure. In particular, the position of the components shown in FIGS. 10A-10B corresponds to the positions of the components shown in FIG. 9A.

The ejector shaft driver assembly 1000 is in communication with multiple ejector shafts 700, referred to herein as the ejector shafts 700*a*-700*c*, via corresponding links 703, referred to herein as the links 703*a*-703*c*. As previously discussed, multiple ejectors 600*a*-600*h* are mounted to each of the ejector shafts 700*a*-700*c*. It is noted that, for clarity, only the ejectors 600*a*-600*h* that are mounted to the ejector shaft 700*a* are labeled. The ejector shaft driver assembly 1000 may include a bracket 1003, a cam 1006, a plate 1009, one or more guides 1013*a*-1013*b*, one or more pins 1015*a*-1015*c*, and possibly other. Each of the links 703*a*-703*c* is pivotably and/or rotatably connected to plate 1009 using the pins 1015*a*-1015*c* that are inserted into the slots 706*a*-706*c* in the links 703, referred to herein as the links 703*a*-703*c*.

The bracket 1003 may mount to the ice formation tray 226 (FIGS. 4A-4B) and support various components of the ejector shaft driver assembly 1000. To this end, the bracket 1003 may include mounting holes 1016*a*-1016*b*. Fasteners (not shown) may extend through the mounting holes 1016*a*-1016*b* and facilitate mounting the bracket 1003 to the ice formation tray 226. The bracket 1003 may also include an opening 1019 for the cam 1006.

Figure 11A:
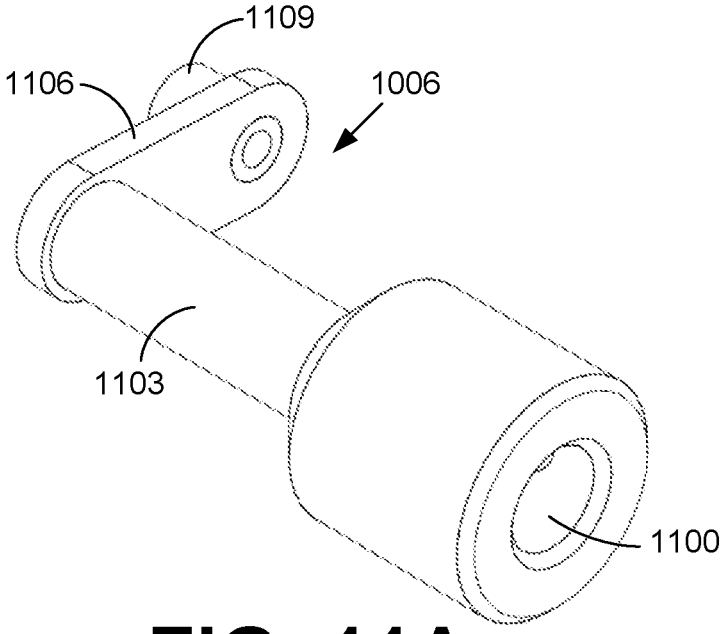
FIGS. 11A-11B show examples of a cam for the ejector shaft driver assembly of FIGS. 10A-10B according to various embodiments of the present disclosure.
Figure 11B:
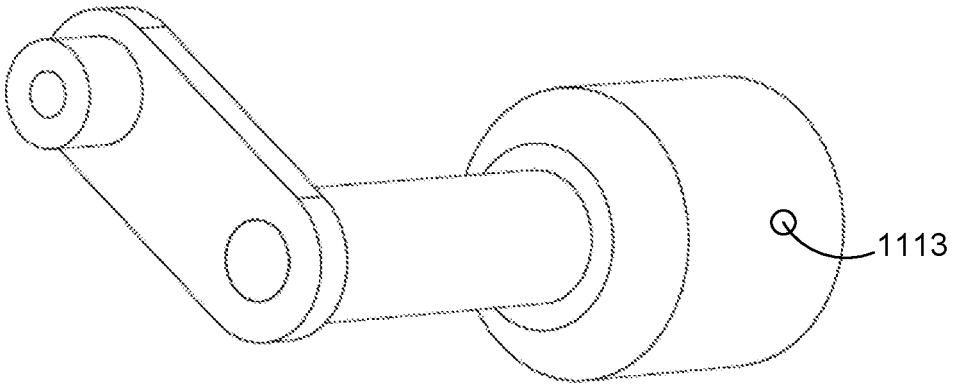

Turning now to FIGS. 11A-11B, shown is an example, among others, of the cam 1006 according to various embodiments. As will be discussed in further detail later, the cam 1006 is configured to rotate to thereby drive the plate 1009 (FIG. 10A-10B). To this end, the cam 1006 may include a receptacle 1100, a shaft 1103, a link 1106, an extension 1109, and possibly other features. The receptacle 1100 may receive and be connected to a rod (not shown) or other type of component that is configured to rotate the cam 1006 about an axis defined by the shaft 1103. In some embodiments, the receptacle 1100 may include an orifice 1113 (visible in FIG. 11B) that receives a pin, set screw, or other type of retaining element that facilitates retaining the receptacle 1100 to the rod (not shown) or other type of component that rotates the cam 1006. The extension 1109, which extends from an end of the link 1106, is configured to extend through a slot in the plate 1009 (FIGS. 10A-10B).

Figure 12:
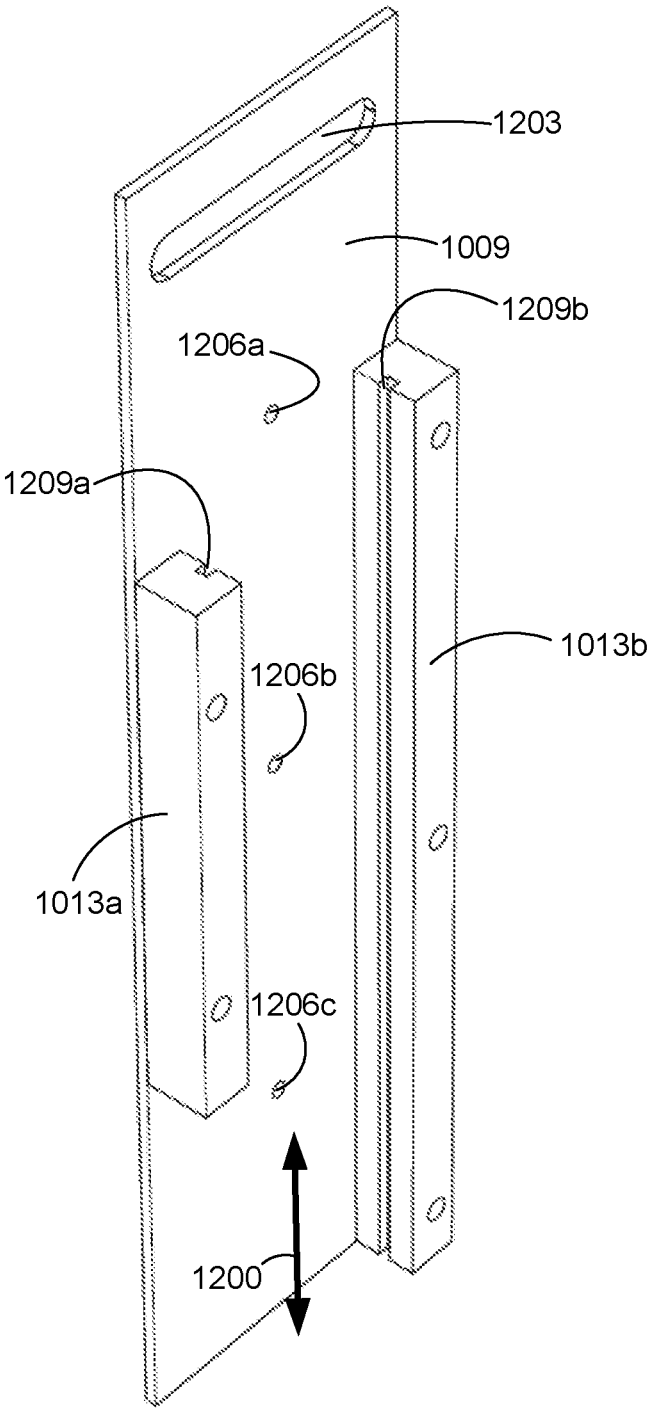
FIG. 12 shows an example of a plate and guides for the ejector shaft driver assembly of FIGS. 10A-10B according to various embodiments of the present disclosure.

Referring now to FIG. 12, shown is the plate 1009 and the guides 1013*a*-1013*b* according to various embodiments of the present disclosure. As will be discussed in more detail later, the cam 1006 (FIGS. 11A-11B) is configured to move the plate 1009 in the directions indicated generally by the arrow 1200. Because the guides 1013*a*-1013*b* are attached to the plate 1009, the guides 1013*a*-1013*b* move in conjunction with the plate 1009 in the directions indicated generally by the arrow 1200.

The plate 1009 may include a slot 1203, one or more pin receptacles 1206, and possibly other features. The slot 1203 is configured to receive and guide the extension 1109 (FIGS. 11A-11B) of the cam 1006 (FIGS. 11A-11B). Thus, when the cam 1006 rotates, the extension 1109 causes the plate 1009 to move in the directions indicated generally by the arrow 1200. The pin receptacles 1206 receive and retain the pins 1015*a*-1015*c* (FIGS. 10A-10B) to the plate 1009. The pin receptacles 1206, in conjunction with the pins 1015*a*-1015*c*, may serve as a point about which the links 703*a*-703*c* (FIGS. 10A-10B) pivot and/or slide to cause the ejectors 600*a*-600*h* to rotate, as will be discussed in more detail later.

The guides 1013*a*-1013*b* may include channels 1209*a*-1209*b* that receive the bracket 1003 (FIG. 10A). As the plate 1009 moves in the directions generally indicated by the arrow 1200, the guides 1013*a*-1013*b*, and thus the plate 1009, is guided by the bracket 1003.

Figure 13A:
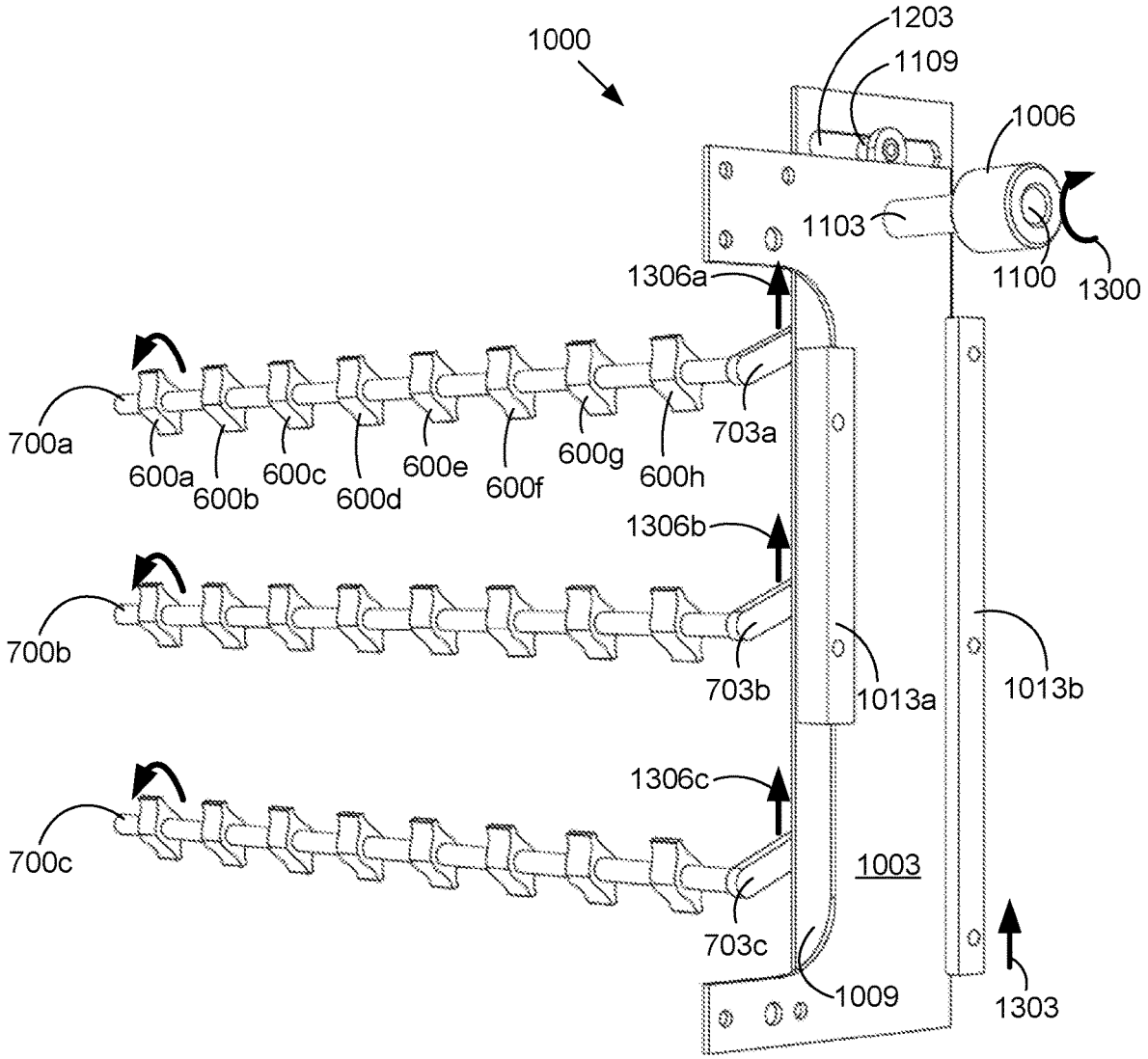
FIGS. 13A-13B show examples of the ejector shaft driver assembly of FIGS. 10A-10B for the ice making system of FIG. 2 according to various embodiments of the present disclosure.
Figure 13B:
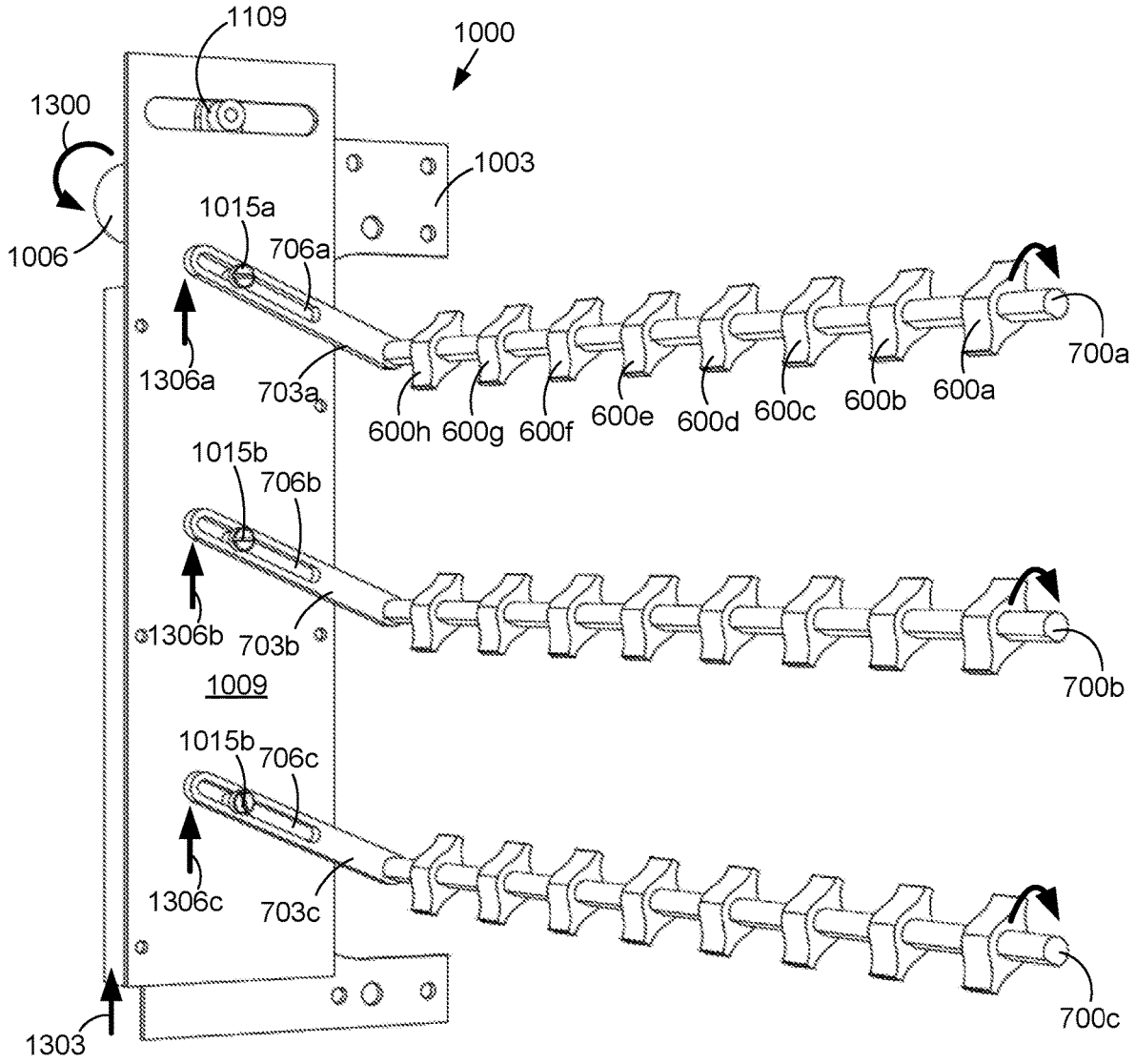

Turning now to FIGS. 13A-13B, shown is an example, among others, of movement of the ejector shaft driver assembly 1000 and its interactions with other components according to various embodiments of the present disclosure. In particular, the position of the components shown in FIGS. 10A-10B corresponds to the positions of the components shown in FIG. 9B. The ejector shaft driver assembly 1000 may arrive in the position shown, for example, upon a motor rotating the cam 1006 90 degrees from the position show in FIGS. 10A-10B via a rod (not shown) connected to the receptacle 1100 of the cam 1006. Accordingly, the cam 1006 rotates, as indicated generally by the arrow 1300, about an axis defined by the shaft 1103 of the cam 1006. Because the extension 1109 of the cam 1006 is located in the slot 1203 of the plate 1009, the rotation of the cam 1006 causes the plate 1009 to move with respect to the bracket 1003 in the direction indicated generally by the arrow 1303. Because the bracket 1003 is within the channels 1209*a*-1209*b* (FIG. 12) of the guides 1013*a*-1013*b*, the movement of the plate 1009 is guided by the bracket 1003.

By the plate 1009 moving in the direction indicated generally by the arrow 1303, the pins 1015*a*-1015*c* also move in the direction indicated generally by the arrow 1303. As such, the pins 1015*a*-1015*c* slide within the slots 706*a*-706*c* of the links 703*a*-703*c* so that the links 703*a*-703*c* rotate about an axis defined by the ejector shafts 700*a*-700*c*. Also, the ends of the links 703*a*-703*c* that are distal to the ejector shafts 700*a*-700*c* move in the direction indicated generally by the arrows 1306*a*-1306*c*, while the ends of the links 703*a*-703*c* that are proximal to the ejector shafts 700*a*-700*c* remain in a substantially fixed location. This maneuver causes the ejector shafts 700*a*-700*c* and the ejectors 600*a*-600*h* to rotate to the position shown in FIGS. 13A-13B to facilitate the removal of ice pieces 203 (FIG. 2) from the ice formation tray 226 (FIGS. 4A-4B) and the evaporator tube 229.

The motor (not shown) may continue to rotate the cam 1006 in the direction indicated generally by the arrow 1300, so that the cam 1006 has rotated 180 degrees with respect to the position shown in FIGS. 13A-13B. In this position, the plate 1009 and the pins 1015*a*-1015*c* will have moved in the direction opposite to the direction generally indicated by the arrows 1303. In response, the pins 1015*a*-1015*c* may slide within the slots 706*a*-706*c* and move the ends of the links 703*a*-703*c* that are distal to the ejector shafts 700*a*-700*c* in the direction that is opposite to the direction generally indicated by the arrows 1306*a*-1306*c*. This position corresponds to the positions of the components shown in FIG. 9C.

Thereafter, the motor (not shown) may continue to rotate the cam 1006 to the position shown in FIGS. 10A-10B. The process described above may be repeated whenever the ice making system 200 is to remove ice pieces 203 from the ice formation tray 226 and the evaporator tube 229.

Figure 14A:
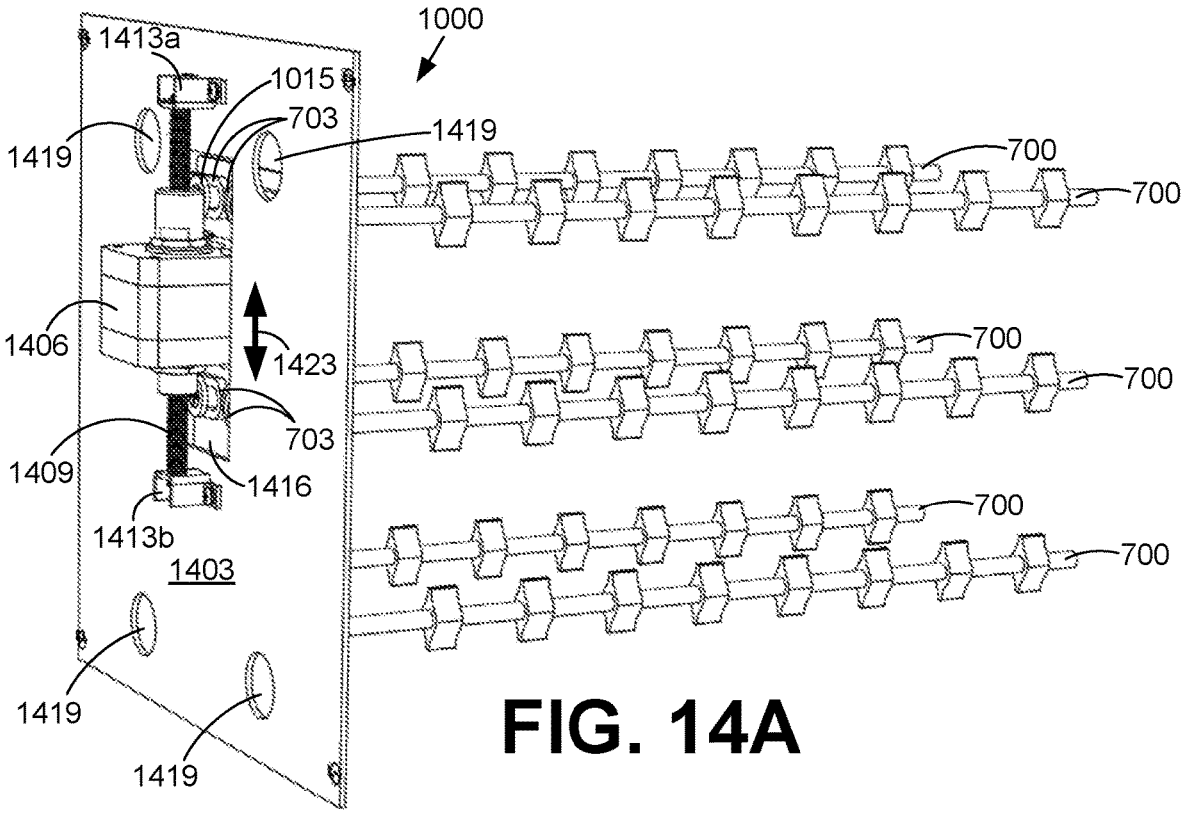
FIGS. 14A-14B show an example of another ejector shaft driver assembly for the ice formation assembly of FIGS. 9A-9C according to various embodiments of the present disclosure.
Figure 14B:
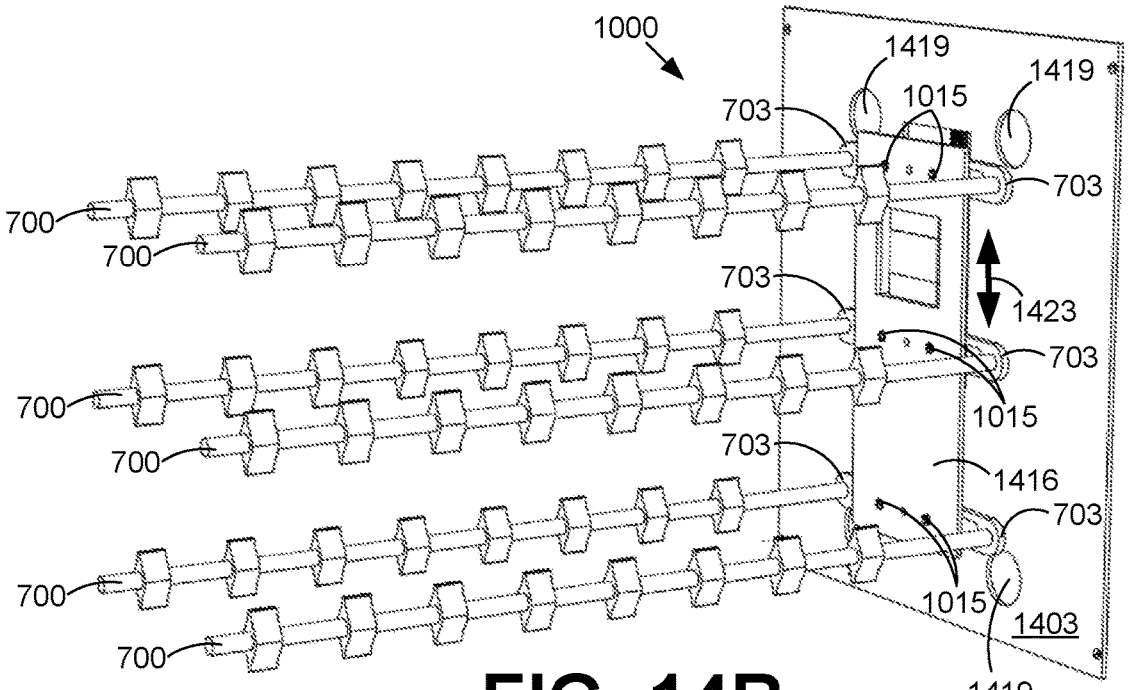

Reference is now made to FIGS. 14A-14B, which shows an example of another ejector shaft driver assembly 1000 according to various embodiments of the present disclosure. In particular, the ejector shaft driver assembly 1000 in the embodiment shown is configured to drive the ejector shafts 700 for two ice formation trays 226 (FIGS. 4A-4B). Similar embodiments may be used to drive ejector shafts 700 for other numbers of ice formation trays 226. The position of the components shown in FIGS. 14A-14B corresponds to the positions of the components shown in FIG. 9A.

In the embodiment shown in FIGS. 14A-14B, the ejector shaft driver assembly 1000 includes a mounting plate 1403, a motor 1406 (visible in FIG. 14A), a shaft 1409 (visible in FIG. 14A), one or more mounts 1413*a*-1413*b* (visible in FIG. 14A), a bracket 1416, multiple links 703, multiple pins 1015 (visible in FIG. 14B), and other components not discussed in detail herein for brevity. The ejector shaft driver assembly 1000 is configured to cause the ejector shafts 700 to rotate, thereby facilitating removal of the ice pieces 203 (FIG. 2) from the evaporator tubes 229 (FIG. 2).

The mounting plate 1403 may mount to the ice formation tray 226 (FIGS. 4A-4B) and support various components of the ejector shaft driver assembly 1000. To this end, the mounting plate 1403 may include mounting holes (not shown). Fasteners (not shown) may extend through the mounting holes and attach the mounting plate 1403 to the ice formation tray 226. The mounting plate 1403 may also include one or more openings 1419 through which the evaporator tubes 229 may pass.

The motor 1406 in the present example is embodied in the form of a linear motor. However, other types of motors may be used in various embodiments. The motor 1406 includes a passageway through which the shaft 1409 may traverse. The shaft 1409 may be threaded, such that rotational motion produced by the motor 1406 causes the shaft 1409 to rotate and displace the shaft 1409 longitudinally with respect to the motor 1406.

The mounts 1413*a*-1413*b* are attached to the mounting plate 1403 using, for example, screws or any other type of attachment mechanism. Additionally, each end of the shaft 1409 may be attached to one of the mounts 1413*a*-1413*b* such that the shaft 1409 does not rotate with respect to the mounts 1413*a*-1413*b*. Because the shaft 1409 does not rotate with respect to the mounts 1413*a*-1413*b*, rotational motion produced by the motor 1406 results in the motor 1406 moving in the direction indicated generally by the arrow 1423.

The bracket 1416 is attached to the motor 1406. In addition, the bracket 1516 is in communication with the ejector shafts 700 via the links 703. The links 703 are mounted to the bracket 1416 such that movement of the bracket 1416 in the direction indicated generally by the arrow 1423 results in the links 703 rotating and/or pivoting about the pins 1015.

As previously mentioned, the rotational motion caused by the motor 1406 results in the motor 1406 moving in the direction indicated generally by the arrow 1423. In this sense, the rotational motion from the motor 1406 is transformed into linear motion via the threaded shaft 1409, resulting in the motor 1406 being moved linearly along the shaft 1409. Because the motor 1406 is mounted to the bracket 1416, the bracket 1416 is also moved in the direction indicated generally by the arrow 1423. As a result, the links 703 pivot and/or rotate about the corresponding pins 1015. In turn, the ejector shafts 700 rotate about their respective longitudinal axes. If ice pieces 203 have been generated on the evaporator tube 229, this maneuver may cause the ice pieces 203 to be removed from the evaporator tube 229. The motor 1406 may then reverse the direction of its rotational motion, and the motor 1406 may then travel is the direction that is opposite with respect to its previous direction. This maneuver may result in more of the ice pieces 203 being dislodged from the evaporator tube 229. This cycle may be repeated whenever it is desired to remove ice pieces 203 from the evaporator tube 229.

Figure 15:
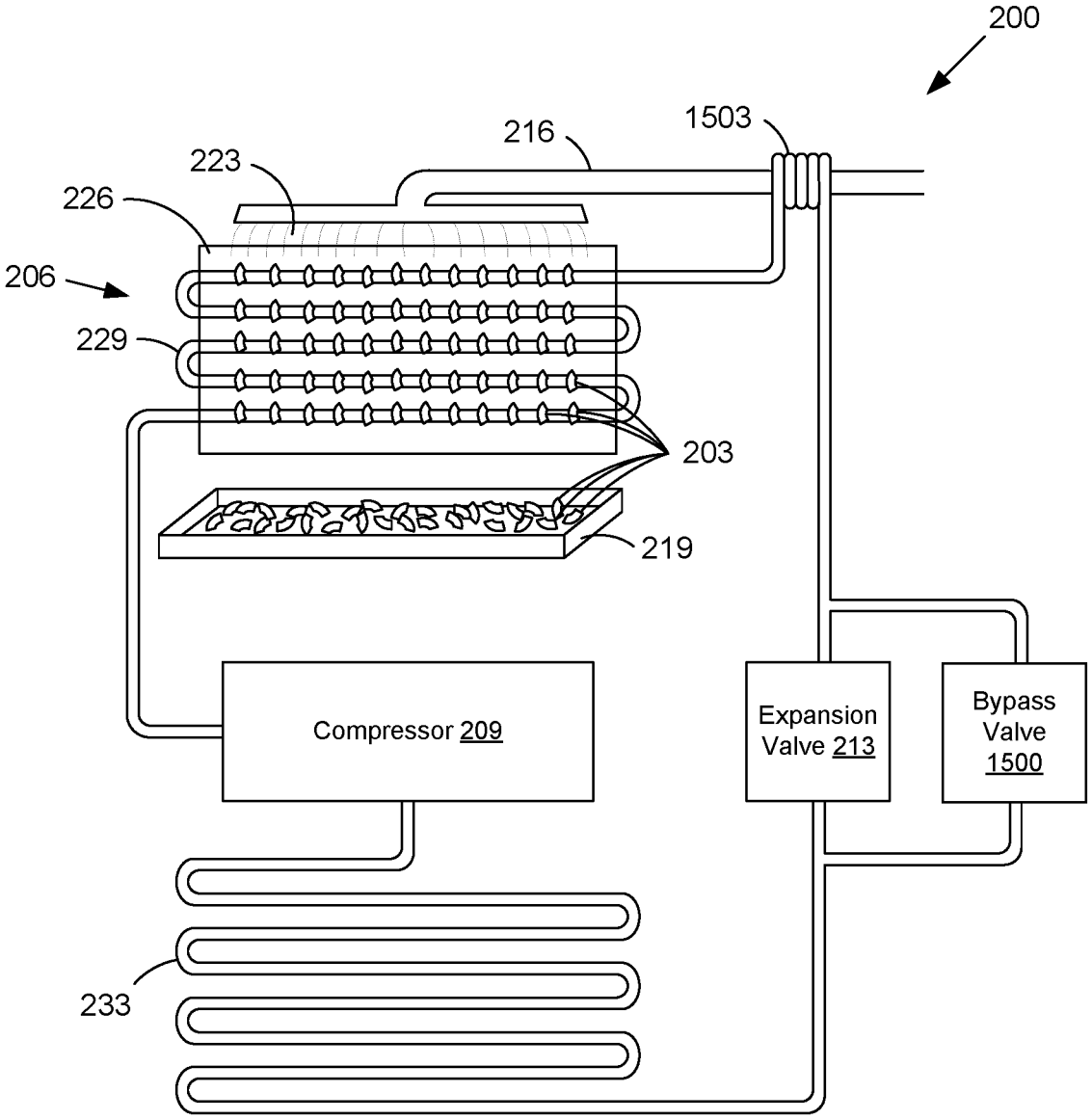
FIG. 15 shows an example of another ice making system according to various embodiments of the present disclosure.

Turning now to FIG. 15, shown is a schematic drawing of another ice making system 200 according to various embodiments of the present disclosure. The present embodiment of the ice making system 200 is similar to the embodiment shown with respect to FIG. 2. However, in the present embodiment, the ice making system 200 further includes a bypass valve 1500 and a chiller 1503. The bypass valve 1500 is configured to facilitate melting portions of the ice pieces 203 to thereby facilitate the ejector 600 (FIG. 6) removing the ice pieces 203 from the ice formation cells 103 (FIG. 5). As such, after the ice pieces 203 have been generated, the bypass valve 1500 may open to facilitate the relatively warm refrigerant in the condenser tube 233 bypassing the expansion valve 213. By bypassing the expansion valve 213, the relatively warm refrigerant may flow into the evaporator tube 229. The evaporator tube 229 may then warm to a level that causes the ice pieces 203 to begin to melt. More specifically, the portions of the ice pieces 203 that make contact with the evaporator tube 229 may begin to melt. As such, the ejectors 600 may experience less resistance when removing the ice pieces 203 from the evaporator tube 229 and the ice formation tray 226.

The chiller 1503 is configured to reduce the temperature of the water stream 223 prior to the water stream 223 being provided to the ice formation tray 226 and thus the ice formation cells 103. To this end, a tube may be, for example, coiled around a segment of the water supply 216, and a fluid that lowers the temperature of the tube may pass through the tube. Thus, in some embodiments, the chiller 1503 may be embodied in the form of a portion of the evaporator tube 229 that is coiled around the water supply 216, and the relatively cool refrigerant may cause the temperature of the water stream 223 to lower prior to the water stream 223 being provided to the ice formation tray 226.

Figure 16:
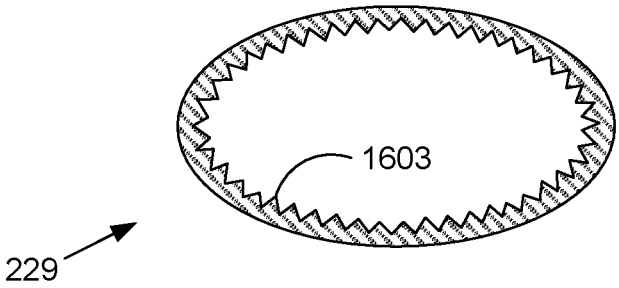
FIG. 16 shows an example of a cross-section of the evaporator tube for the ice making system of FIGS. 2 and 15 according to various embodiments of the present disclosure.

Turning now to FIG. 16, shown is an example of a cross-section of the evaporator tube 229 according to various embodiments of the present disclosure. In the present embodiment, the evaporator tube 229 has an oval shape. However, in alternative embodiments, the evaporator tube 229 may have a cross-section that is, for example, rectangular, triangular, hexagonal, octagonal, or any other type of shape. Additionally, the evaporator tube 229 in the present example has an inner wall 1603 that is grooved. According to various embodiments, the grooves formed in the inner wall 1603 may be helical with the grooves spiraling as the grooves traverse the longitudinal length of the evaporator tube 229. By having a grooved inner wall 1603, the evaporator tube 229 may have improved heat transfer characteristics as compared to an evaporator tube 229 with an inner wall 1603 that is not grooved, due to the fact that the cold gases may spiral through the evaporator tube 229.

According to various embodiments, the evaporator tube 229 may comprise various types of materials. For example, the evaporator tube 229 may comprise stainless steel, copper, copper with a tin coating, copper with a nickel coating, or any combination thereof. For embodiments with the evaporator tube 229 comprising copper with a coating, an electrolyzed plating process may be used to generate the coating. In some embodiments, an evaporator tube 229 with a wall thickness of approximately 0.7 mm may be used. However, other wall thicknesses may be used as well.

Figure 17A:
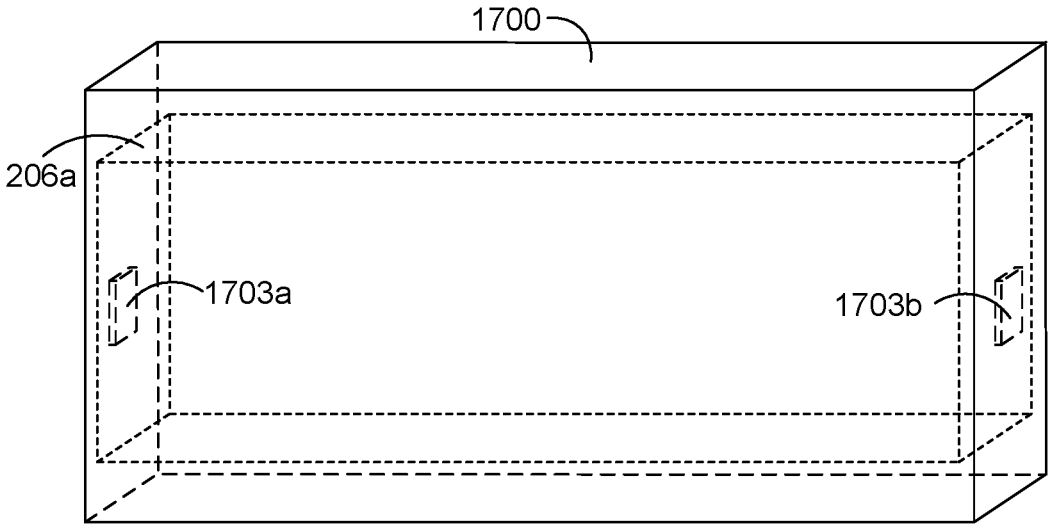
FIGS. 17A-17B show examples of a housing for the ice making system of FIGS. 2 and 15 according to various embodiments of the present disclosure.

Turning now to FIG. 17A, shown is a diagram of a housing 1700 for at least a portion of the ice formation assembly 206, referred to herein as the ice formation assembly 206, according to various embodiments of the present disclosure. In particular, shown is the housing 1700 and the ice formation assembly 206*a* mounted within the housing 1700. The housing 1700 may include one or more attachment points 1703*a*-1703*b* to which one or more components of the ice formation assembly 206 is attached. For instance the bracket 1003 (FIGS. 13A-13B) of the ejector shaft driver assembly 1000 (FIGS. 13A-13B) may attach to the attachment points 1703*a*-1703*b*.

Figure 17B:
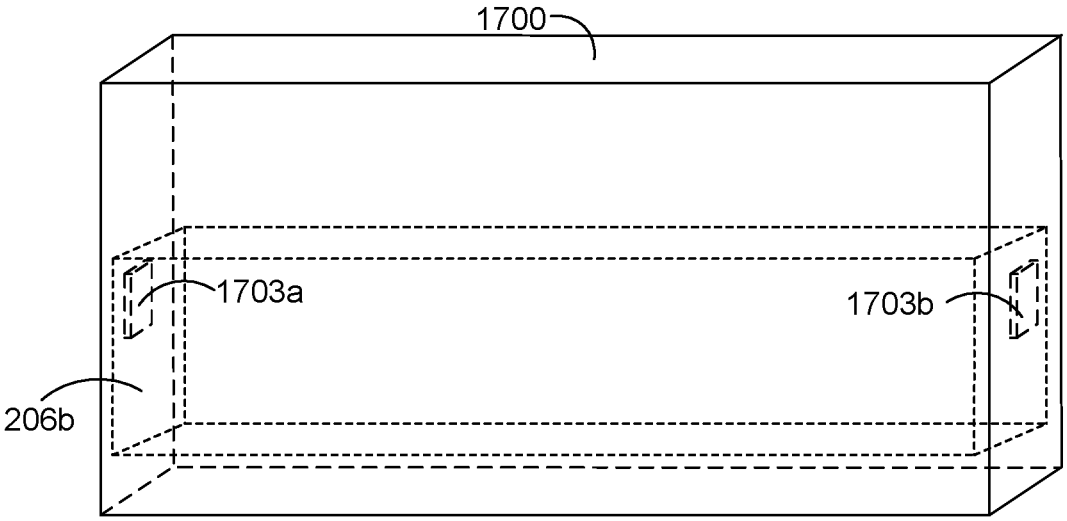

Referring now to FIG. 17B, shown is a schematic diagram of the housing 1700 for at least a portion of another ice formation assembly 206, referred to herein as the ice formation assembly 206*b*, according to various embodiments of the present disclosure. The housing 1700 and the ice formation assembly 206*b* are similar to those discussed in reference to FIG. 17A. However, the ice formation assembly 206*b* in the present embodiment is a different size than the ice formation assembly 206*a* of FIG. 17A. In accordance with the present disclosure, the housing 1700 and other components within and related to the housing 1700 may be compatible with both the ice formation assembly 206*a*, the ice formation assembly 206*b*, and possibly other ice formation assemblies 206.

The ice formation assemblies 206*a*-206*b* may have corresponding ice formation trays 226 that are different sizes, shapes, and/or configurations. For instance, each ice formation tray 226 may have a different quantity of ice formation cells 503 (FIG. 5). Additionally, each ice formation tray 226 may have ice formation cells 503 that are of a different size or shape. Thus, a housing 1700 may be constructed that accommodates multiple ice formation assemblies 206*a*-206*b* and/or ice formation trays 226, and users may be able to switch between various ice formation assemblies 206*a*-206*b* and/or ice formation trays 226.

It is emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A system, comprising:

an ice formation tray that comprises an ice formation cell;

a refrigerant tube disposed within the ice formation cell;

a water spray guide mounted to an end of the ice formation tray, the water spray guide being configured to receive water from a water supply and provide a water stream to the ice formation cell, the water spray guide further comprising a connector, a water bin, and a lid;

an ejector shaft that extends through the ice formation cell; and an ejector that is directly attached to the ejector shaft at a point between a first end and a second end of the ejector, the first end or the second end of the ejector being configured to rotate about an axis of the ejector shaft to pry at least one ice piece away from the ice formation cell.

2. The system of claim 1, wherein the ice formation cell comprises a first ice formation cell, and the system further comprises:

a bevel that separates the first ice formation cell from a second ice formation cell along a first respective axis that is parallel to the axis of the ejector shaft;

a divider that separates the first ice formation cell from a third ice formation cell along a second respective axis that intercepts the axis of the ejector shaft.

3. The system of claim 1, wherein the ejector further comprises a bore that includes an opening in at least one side of the ejector, wherein a portion of a perimeter of the opening has a flat surface, and the ejector shaft is inserted into the bore.

4. The system of claim 1, wherein the ice formation tray comprises a receptacle, and wherein the water bin comprises an extension that inserts into the receptacle of the ice formation tray.

5. The system of claim 1, wherein the water bin comprises a plurality of orifices, wherein at least two of the plurality of orifices are configured to provide a portion of the water stream.

6. The system of claim 5, wherein the plurality of orifices comprise a first orifice with a first diameter and a second orifice with a second diameter, the first diameter being larger than the second diameter, the first orifice being further away from the connector than the second orifice.

7. The system of claim 1, further comprising an ejector shaft drive assembly comprising the ejector shaft, the ejector mounted on the ejector shaft, and at least one of: a cam, a plate, a guide, and a pin.

8. The system of claim 1, further comprising a cam comprising a receptacle, a shaft, a link, and an extension, the cam being configured to cause the ejector shaft to rotate.

9. The system of claim 1, wherein the ejector is further configured to simultaneously pry the ice piece from the one of the plurality of ice formation cells on a first side of the ice formation tray and pry a second ice piece from another one of the plurality of ice formation cells on a second side of the ice formation tray.

10. The system of claim 1, further comprising:

a first bore in the ice formation tray at a first location, wherein a first portion of the refrigerant tube extends through the first bore along a first respective axis that is parallel to the axis of the ejector shaft; and a second bore in the ice formation tray at a second location, wherein a second portion of the refrigerant tube extends through the second bore a second respective axis that is parallel to the axis of the ejector shaft.

* * * * *